US012648683B2

(12) United States Patent
Büsing et al.

(10) Patent No.: US 12,648,683 B2
(45) Date of Patent: Jun. 9, 2026

(54) DISHWASHER

(71) Applicant: SAMSUNG ELECTRONICS CO., LTD., Suwon-si (KR)

(72) Inventors: Johannes Büsing, Suwon-si (KR); Heedong Roh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 60 days.

(21) Appl. No.: 18/582,139

(22) Filed: Feb. 20, 2024

(65) Prior Publication Data

US 2024/0315528 A1 Sep. 26, 2024

Related U.S. Application Data

(63) Continuation of application No. PCT/KR2024/000749, filed on Jan. 16, 2024.

(30) Foreign Application Priority Data

Mar. 21, 2023 (KR) ..... 10-2023-0036831

(51) Int. Cl.

| | |
|---|---|
| ***A47L 15/22*** | (2006.01) |
| ***A47L 15/42*** | (2006.01) |
| ***A47L 15/50*** | (2006.01) |

(52) U.S. Cl.

CPC ..... *A47L 15/508* (2013.01); *A47L 15/22* (2013.01); *A47L 15/42* (2013.01); *A47L 15/4214* (2013.01); *A47L 15/4278* (2013.01); *A47L 15/428* (2013.01); *A47L 15/4282* (2013.01); *A47L 15/50* (2013.01); *A47L 15/501* (2013.01)

(58) Field of Classification Search

None

See application file for complete search history.

(56) References Cited

U.S. PATENT DOCUMENTS

| | | | |
|---|---|---|---|
| 8,166,983 | B2 | 5/2012 | Clerkin |
| 10,092,160 | B2 | 10/2018 | Ju et al. |
| 10,231,598 | B2 | 3/2019 | Cho et al. |
| 10,264,946 | B2 | 4/2019 | Choi et al. |
| 2004/0000331 | A1 | 1/2004 | Elick et al. |
| 2017/0181600 | A1 | 6/2017 | Blanchard et al. |

(Continued)

FOREIGN PATENT DOCUMENTS

| | | | |
|---|---|---|---|
| CN | 102008277 | B | 1/2015 |
| CN | 208625635 | U | 3/2019 |

(Continued)

OTHER PUBLICATIONS

International Search Report dated May 10, 2024 issued in PCT Application No. PCT/KR2024/000749.

(Continued)

*Primary Examiner* — Levon J Shahinian

(74) *Attorney, Agent, or Firm* — STAAS & HALSEY LLP

(57) ABSTRACT

A dishwasher may include a tub, a basket inside the tub, and to accommodate objects to wash therein, and the basket including a wire forming the basket, and a duct detachably coupled to the basket to guide washing water to be sprayed into the objects. The duct includes a first fixing protrusion to fix an upper portion of the wire. The duct includes a second fixing protrusion to fix a lower portion of the wire. The second fixing protrusion is spaced apart from the first fixing protrusion along an extension direction of the wire.

12 Claims, 24 Drawing Sheets

(56) References Cited

U.S. PATENT DOCUMENTS

| | | | |
|---|---|---|---|
| 2019/0290099 | A1 | 9/2019 | Agrawal |
| 2022/0313057 | A1 | 10/2022 | Patil et al. |

FOREIGN PATENT DOCUMENTS

| | | | |
|---|---|---|---|
| CN | 215605530 | U | 1/2022 |
| CN | 110859565 | B | 2/2023 |
| EP | 2 166 918 | B1 | 10/2010 |
| EP | 3 197 334 | B1 | 9/2019 |
| EP | 4 006 723 | A1 | 10/2022 |
| KR | 10-2008-0012597 | | 2/2008 |
| KR | 10-2008-0088123 | | 10/2008 |
| KR | 10-1414677 | | 7/2014 |
| KR | 10-2016-0040075 | | 4/2016 |
| KR | 10-2017-0081936 | | 7/2017 |
| KR | 10-1890623 | | 8/2018 |

OTHER PUBLICATIONS

Written Opinion dated May 10, 2024 issued in PCT Application No. PCT/KR2024/000749.
Supplementary European Search Report dated Jan. 21, 2026 issued in European Application No. EP 24 77 5043.

DISHWASHER

CROSS-REFERENCE TO RELATED APPLICATIONS

This is a continuation application of International Application No. PCT/KR2024/000749, filed Jan. 16, 2024, which is incorporated herein by reference in its entirety, it being further noted that foreign priority benefit is based upon Korean Patent Application No. 10-2023-0036831, filed Mar. 21, 2023, which are incorporated by reference herein in their entirety.

TECHNICAL FIELD

The present disclosure relates to a dishwasher.

BACKGROUND ART

A dishwasher is a device that automatically cleans food residues from dishes using detergent and washing water.

A dishwasher may include a main body disposed inside the main body, a tub, a basket disposed inside the tub to store dishes, a spray unit provided to spray washing water into the basket, and a duct for guiding the washing water to the spray unit.

For example, the spray unit may be coupled to the duct to receive the washing water, and the duct may be mounted on the basket. When the duct is not properly aligned with the basket, the duct and/or the spray unit may interfere with the dishes. In addition, an assembly tolerance may be required for assembly of the basket and the duct. However, the basket and the duct may be easily shaken due to the assembly tolerance.

DISCLOSURE

Technical Problem

One aspect of the present disclosure provides a dishwasher with improved space utilization.

One aspect of the present disclosure provides a dishwasher with improved ease of assembly.

One aspect of the present disclosure provides a dishwasher capable of preventing a duct and/or a spray unit from interfering with dishes.

One aspect of the present disclosure provides a dishwasher capable of reducing an assembly tolerance of a basket and duct.

One aspect of the present disclosure provides a dishwasher with improved coupling force between a basket and a duct.

Technical tasks to be achieved in this document are not limited to the technical tasks mentioned above, and other technical tasks not mentioned will be clearly understood by those skilled in the art from the description below.

Technical Solution

An aspect of the present disclosure provides a dishwasher including a tub, a basket inside the tub, and to accommodate objects to wash therein, the basket including a wire forming the basket, and a duct detachably coupled to the basket to guide washing water to be sprayed into the objects. The duct may include a first fixing protrusion to fix an upper portion of the wire. The duct may include a second fixing protrusion to fix a lower portion of the wire. The second fixing protrusion may be spaced apart from the first fixing protrusion along an extension direction of the wire.

An aspect of the present disclosure provides a dishwasher including a tub, a basket disposed inside the tub, a spray rotor to spray washing water toward dishes, and a duct to guide washing water to the spray rotor. The basket may include a bottom part supporting the dishes, an opening through which a portion of the bottom part is open, and a plurality of wires forming the bottom part and the opening. The duct may include a duct body having a flow path therein for the washing water to flow, and a fixing member extending to intersect an extension direction of the duct body and to fix the basket.

The duct may further comprise a duct body having a flow path therein for the washing water to flow, an extension body extending from the duct body, and a fixing part formed on one side of the extension body, and comprising the first fixing protrusion and the second fixing protrusion.

The extension direction of the wire may be a first direction, the fixing part is a first fixing part, and the duct further comprises: a second fixing part formed on an other side of the extension body, the second fixing part comprising: a third fixing protrusion spaced apart from the first fixing protrusion along a second direction intersecting the first direction; and a fourth fixing protrusion spaced apart from the second fixing protrusion along the second direction.

The wire may be a first wire extending along a first direction, the basket further comprises a second wire spaced apart from the first wire along a second direction intersecting the first direction and extending along the first direction, and the duct further comprises: a third fixing protrusion to fix an upper portion of the second wire; and a fourth fixing protrusion provided to be spaced apart from the third fixing protrusion along the first direction and to fix a lower portion of the second wire.

The extension direction of the wire may be a first direction, and the first fixing protrusion and the second fixing protrusion protrude further than the wire along a second direction intersecting the first direction.

The extension direction of the wire may be a first direction, the duct body is extending along the first direction based on the duct being coupled to the basket, and the extension body is extending along a second direction intersecting the first direction based on the duct being coupled to the basket.

The basket may further comprise an opening to allow washing water to pass therethrough, and the duct is coupled to the basket by rotating with respect to the basket based on the extension body being placed in the opening.

The extension direction of the wire may be a first direction, the rotation of the duct comprises rotation to move the duct from a first position to a second position, the extension body is disposed in the opening to extend along a diagonal direction of the opening based on the duct being in the first position, and the extension body is disposed in the opening to extend along a second direction intersecting the first direction based on the duct being in the second position.

The rotation of the duct may include rotation to move the duct from a first position to a second position, the duct body is inclined at a predetermined angle with respect to the wire based on the duct being in the first position, and the duct body is disposed to extend along the first direction based on the duct being in the second position.

An extension length of the extension body may be shorter than a length of the opening in the diagonal direction.

Based on the duct being in the first position, a distance between the first fixing protrusion and the second fixing protrusion may be longer than a height of the wire.

The duct may further comprise a fixing groove formed between the first fixing protrusion and the second fixing protrusion to accommodate the wire, and a distance between the fixing groove and a center of the wire is shorter than a diameter of the wire.

The wire may be a first wire extending along a first direction, the basket further comprises a second wire extending along a second direction intersecting the first direction, and the duct further comprises a hook formed on the duct body to fix the second wire.

The hook may comprise a hook body extending from an upper portion of the duct body and a hook protrusion formed on an end of the hook body to interfere with the second wire, and based on the duct being coupled to the basket, a distance between a lower end of the hook protrusion and the upper portion of the duct body is shorter than a distance between an upper end of the hook protrusion and a lower end of the second wire.

The dishwasher may further comprise a spray rotor to enable communication with the duct to spray washing water guided by the duct into the objects.

A dishwasher may comprise a tub, a basket disposed inside the tub, and to have objects to wash to be placed, a spray rotor to spray washing water toward the objects placed in the basket, and a duct to guide the washing water to the spray rotor. The duct may comprise a duct body having a flow path therein for the washing water to flow, and a fixer extending to intersect an extension direction of the duct body and to fix the basket. The basket may comprise a bottom part supporting the objects, an opening through which a portion of the bottom part is open, and a plurality of wires forming the bottom part and the opening.

The duct may be to enable a first rotation and a second rotation. During the first rotation of the duct, the fixing member may be placed in the opening along a left-right direction of the opening from a state of being placed in the opening along a diagonal direction of the opening. During the second rotation of the duct, the duct body may be close to the basket.

MODE OF THE DISCLOSURE

Figure 1:
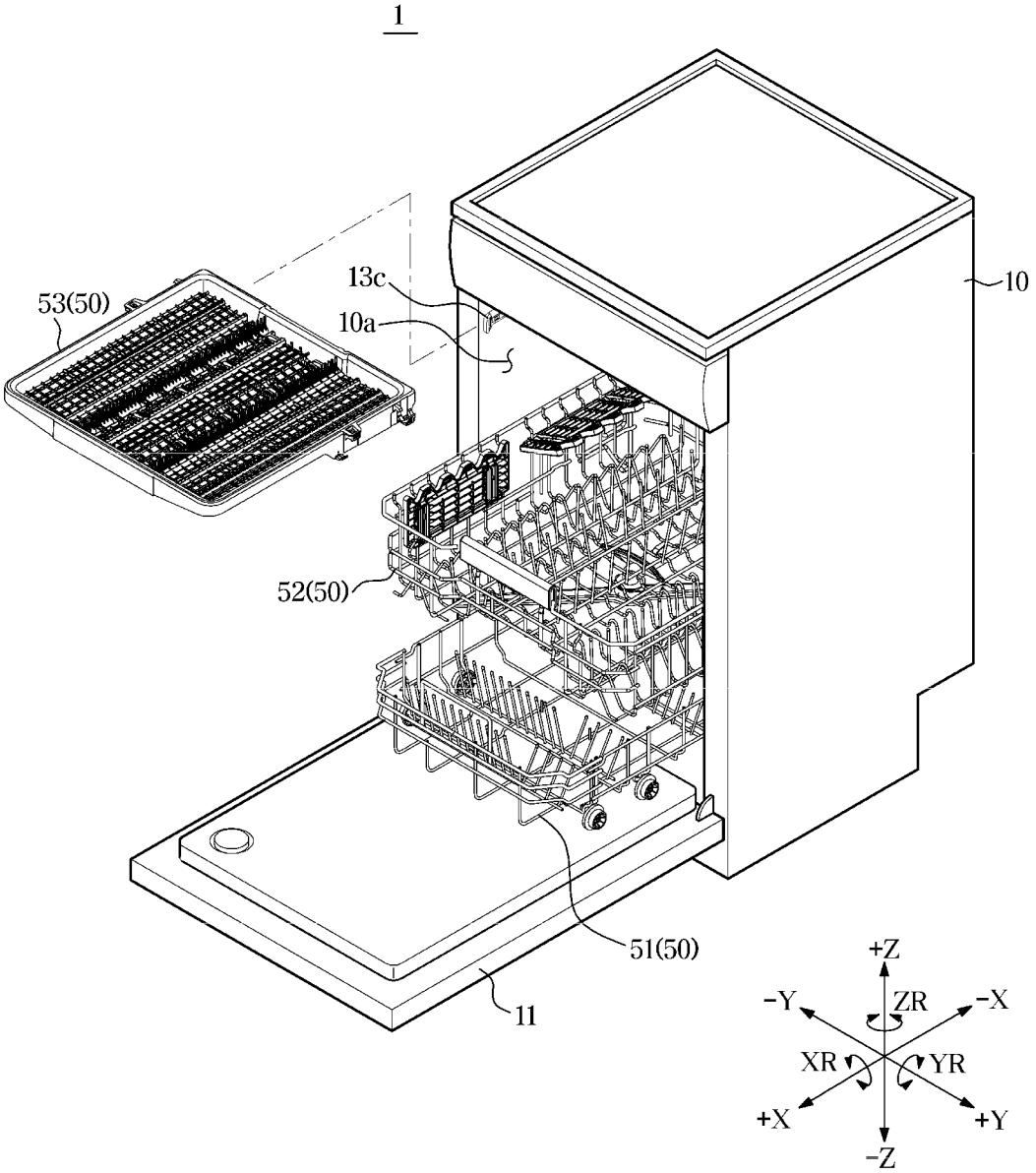
FIG. 1 is a schematic perspective view of an example of a dishwasher according to an embodiment.

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related elements.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other respect (e.g., importance or order).

When any (e.g., first) component is referred to as being "coupled" or "connected" to another (e.g., second) component with or without the terms "functionally" or "communicatively", this means that the any component may be connected to the other component directly (e.g., by a wire), wirelessly, or through a third component.

The terms "comprises" and "has" are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected", "coupled", "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

The terms "front-rear direction," "front," "rear," "left-right direction," "vertical direction," "height direction," "up-down direction," "upper side," "lower side," and the like used in the following description are defined with reference to the drawings, and the shape and position of each component are not limited by these terms.

For example, an X direction may be defined as a front-rear direction. For example, a Y direction may be defined as a left-right direction. For example, a Z direction may be defined as an up-down direction (or vertical direction, height direction). For example, a +X direction may be defined as a forward direction, and a −X direction may be defined as a rearward direction. For example, a +Y direction may be defined as a right direction, and a-Y direction may be defined as a left direction. For example, a +Z direction may be defined as an upward direction, and a −Z direction may be defined as a downward direction. For example, an XR direction may be defined as a rotational direction about an X axis. For example, a YR direction may be defined as a rotational direction about a Y axis. For example, a ZR direction may be defined as a rotational direction about a Z axis.

Hereinafter, embodiments according to the present disclosure will be described in detail with reference to the accompanying drawings.

Figure 2:
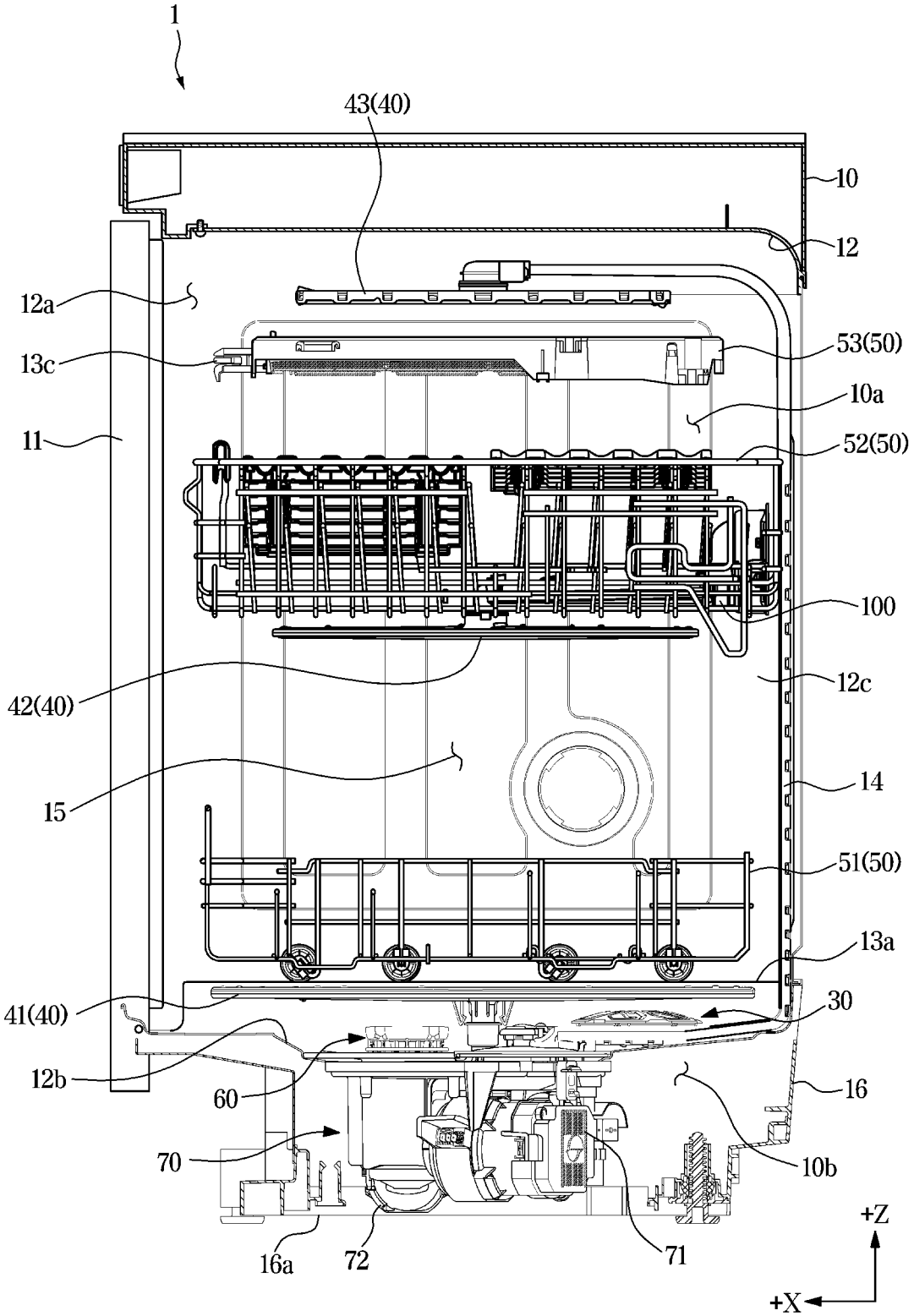
FIG. 2 is a schematic side cross-sectional view of an example of the dishwasher according to an embodiment.

Referring to FIGS. 1 and 2, a dishwasher 1 may include a main body 10. The main body 10 may form an exterior of the dishwasher 1.

The dishwasher 1 may include a tub 12 provided inside the main body 10. The tub 12 may form a washing chamber 10*a*. The tub 12 may be provided in a substantially box shape. One side of the tub 12 may be open. That is, the tub 12 may have an opening 12*a*. As an example, the front of the tub 12 may be open.

The dishwasher 1 may include a door 11. The door 11 may be provided to open and close the tub 12. The door 11 may be provided to open and close the opening 12*a* of the tub 12. The door 11 may be provided to open and close the washing chamber 10*a*. The door 11 may be installed on the main body 10 to open and close the tub 12. The door 11 may be rotatably mounted on the main body 10. The door 11 may be detachably mounted on the main body 10.

The dishwasher 1 may include a storage container 50. The storage container 50 may be provided inside the tub 12. The storage container 50 may accommodate dishes. The storage container 50 may store dishes. The storage container 50 may load dishes. The storage container 50 may hold dishes.

The storage container 50 may include at least one basket provided to store dishes. The storage container 50 may include at least one rack assembly provided to store dishes. The basket and the rack assembly may be replaced with each other. The basket to be described below may be referred to as the rack assembly.

For example, the storage container 50 may include a plurality of baskets 51, 52, and 53. The plurality of baskets 51, 52, and 53 may be provided to store various dishes. However, the present disclosure is not limited thereto. For example, the storage container 50 may include only some of the plurality of baskets 51, 52, and 53. For example, the storage container 50 may further include additional baskets other than the plurality of baskets 51, 52, and 53. For example, the storage container 50 may include a single basket.

The storage container 50 may include a middle basket 52 located at a middle portion in a height direction of the dishwasher 1. The middle basket 52 may be provided to be withdrawn from the tub 12 or inserted into the tub 12. For example, the middle basket 52 may be supported on a middle guide rack (not shown). For example, the middle guide rack (not shown) may be installed on a side surface 12*c* of the tub 12 to be slidable toward the opening 12*a* of the tub 12.

The storage container 50 may include the lower basket 51 located at a lower portion in the height direction of the dishwasher 1. The lower basket 51 may be provided to be withdrawn from the tub 12 or inserted into the tub 12. For example, the lower basket 51 may be provided to be supported on a lower guide rack 13*a*. For example, the lower basket 51 may be installed on the side surface 12*c* of the tub 12 to be slidable toward the opening 12*a* of the tub 12.

Dishes with relatively large volumes may be stored in a plurality of the baskets 51 and 52. However, the types of dishes stored in the plurality of baskets 51 and 52 are not limited to dishes with relatively large volumes. That is, not only dishes with relatively large volumes but also dishes with relatively small volumes may be stored in the plurality of baskets 51 and 52.

The storage container 50 may include an upper basket 53 located at an upper portion in the height direction of the dishwasher 1. The upper basket 53 may be formed in the form of a rack assembly to store dishes with relatively small volumes. For example, the upper basket 53 may store cooking tools or cutlery such as a ladle, knife, and spatula. For example, the upper basket 53 may store a small cup such as an espresso cup. However, the types of dishes stored in the upper basket 53 are not limited to the above examples.

The upper basket 53 may be provided to be withdrawn from the tub 12 or inserted into the tub 12. For example, the upper basket 53 may be moved slidingly by an upper guide rack 13*c*. For example, the upper basket 53 may be provided to be supported by the upper guide rack 13*c*. For example, the upper guide rack 13*c* may be installed on the side surface 12*c* of the tub 12.

The dishwasher 1 may include the washing chamber 10*a*, which is a space formed inside the tub 12. The washing room 10*a* may be defined as an inner space of the tub 12. The washing chamber 10*a* may refer to a space in which dishes held in the storage container 50 may be washed and dried with washing water.

The dishwasher 1 may include a spray device 40 provided to spray washing water. The spray device 40 may spray washing water into the washing chamber 10*a*. The spray device 40 may spray washing water toward the dishes stored in the storage container 50. The spray device 40 may receive washing water from a sump 70, which will be described later.

The spray device 40 may include at least one spray unit. The spray device 40 may include one spray unit or a plurality of spray units 41, 42, and 43.

For example, the spray device 40 may include the first spray unit 41 disposed below the lower basket 51 in the height direction of the dishwasher 1. For example, the spray device 40 may include the second spray unit 42 disposed below the middle basket 52 in the height direction of the dishwasher 1. For example, the spray device 40 may include the third spray unit 43 disposed above the upper basket 53 in the height direction of the dishwasher 1. However, the number of spray units is not limited to the above example. The spray device 40 may include two or fewer spray units. The spray device 40 may include four or more spray units.

Each of the plurality of spray units 41, 42, and 43 may be provided to spray washing water while rotating. Each of the first spray unit 41, the second spray unit 42, and the third spray unit 43 may be provided to spray washing water while rotating. The plurality of spray units 41, 42, and 43 may be referred to as a plurality of spray rotors 41, 42, and 43. The first spray unit 41, the second spray unit 42, and the third spray unit 43 may be referred to as the first spray rotor 41, the second spray rotor 42, and the third spray rotor 43, respectively.

However, the spray device 40 may spray washing water in a manner different from the above-described example. For example, the first spray unit 41, unlike the second spray unit 42 and the third spray unit 43, may be fixed to one side of a lower surface 12*b* of the tub 12. In this case, the first spray unit 41 may be provided to spray washing water in a substantially horizontal direction by a fixed nozzle, and the washing water sprayed from the nozzle of the first spray unit 41 substantially in the horizontal direction may be changed in direction by a switching assembly (not shown) disposed inside the washing chamber 10*a* and move upward. The switching assembly may be installed on a rail (not shown) to enable translational movement along the rail. Although the first spray unit 41 has been described as an example, the second spray unit 42 and the third spray unit 43 may also be provided to spray washing water using a fixed nozzle, similar to the above-described example.

The dishwasher 1 may include an auxiliary spray device 30. The auxiliary spray device 30 may be disposed on one side of a lower portion of the washing chamber 10*a* to spray washing water into some areas of the washing chamber 10*a*. The auxiliary spray device 30 is designed to spray relatively high-pressure water compared to the spray device 40, allowing intensive cleaning of highly contaminated dishes. The auxiliary spray device 30 may be referred to as the auxiliary spray unit 30. The auxiliary spray device 30 may be provided to spray washing water while rotating. The auxiliary spray device 30 may be referred to as the auxiliary spray rotor 40.

The auxiliary spray device 30 may be provided as a component of the spray device 40. Hereinafter, the plurality of spray units may be a concept including at least two of the first spray unit 41, the second spray unit 42, the third spray unit 43, and the auxiliary spray unit 30.

FIG. 2 illustrates the auxiliary spray device 30, but the auxiliary spray device 30 may be omitted from the dishwasher 1.

The dishwasher 1 may include the sump 70. The sump 70 may be provided to accommodate washing water. The sump 70 may collect the washing water in the washing chamber 10*a*. For example, in order for the sump 70 to smoothly collect water, the lower surface 12*b* of the tub 12 may be provided to be inclined downward toward the sump 70. The washing water in the washing chamber 10*a* may flow along the inclination of the lower surface 12*b* of the tub 12 to be smoothly introduced into the sump 70. In addition, the sump 70 may be provided to provide the collected washing water to the spray device 40.

The dishwasher 1 may include a circulation pump 71 provided to pump washing water stored in the sump 70. The circulation pump 71 may be provided as a component of the sump 70. For example, the circulation pump 71 may be disposed in a machine room 10*b*. The washing water pumped by the circulation pump 71 may flow to the spray device 40.

The dishwasher 1 may include a drain pump 72 provided to drain washing water and/or foreign substances (e.g., food residue, etc.) remaining in the sump 70. The drain pump 72 may be provided as a component of the sump 70. For example, the drain pump 72 may be disposed in the machine room 10*b*.

The dishwasher 1 may include the machine room 10*b*, which is a space provided below the tub 12. The machine room 10*b* may be a place where components for circulating washing water are disposed. The dishwasher 1 may include a base frame 16 forming the machine room 10*b*.

For example, at least a portion of the sump 70 may be disposed in the machine room 10*b*. Most of the sump 70 may be disposed in the machine room 10*b*. That is, an area of the sump 70 located in the washing chamber 10*a* may be smaller than an area of the sump 70 located in the machine room 10*b*. By reducing the area of the sump 70 occupying the washing chamber 10*a*, an area of the washing chamber 10*a* may be secured. Accordingly, as the capacity of the washing chamber 10*a* increases, dish acceptance may be improved.

The dishwasher 1 may include a filter assembly 60. The filter assembly 60 may be provided to filter out foreign substances contained in the washing water flowing into the sump 70. The washing water filtered through the filter assembly 60 may be pumped by the circulation pump 71 to be provided to the spray device 40. The filter assembly 60 may be detachably mounted on the sump 70. For example, the filter assembly 60 may include at least one of a fine filter, a coarse filter, and a micro filter.

The dishwasher 1 may include one or more ducts 14 and 100 to guide washing water. The ducts 14 and 100 may deliver washing water to the spray device 40. The ducts 14 and 100 may be disposed inside the tub 12. A duct assembly may be disposed in the washing chamber 10*a*.

For example, the dishwasher 1 may include the first duct 14 provided to guide the washing water introduced from the sump 70. For example, the dishwasher 1 may include the second duct 100 to guide the washing water introduced from the first duct 14 to the spray device 40. For example, the first duct 14 may be provided between the sump 70 and the second duct 100. For example, the second duct 100 may be provided between the first duct 14 and the spray device 40. For example, the first duct 14 and the second duct 100 may be provided as a duct assembly.

However, the present disclosure is not limited to the above-described examples, and the first duct 14 and the second duct 100 may be provided as an integrated configuration. In this case, the integrated duct may guide the washing water introduced from the sump 70 directly to the spray device 40.

Meanwhile, the ordinals of "first" and "second" do not limit the configurations of the first duct 14 and the second duct 100. For example, the first duct 14 and the second duct 100 may be referred to oppositely as the second duct 14 and the first duct 100.

Figure 3:
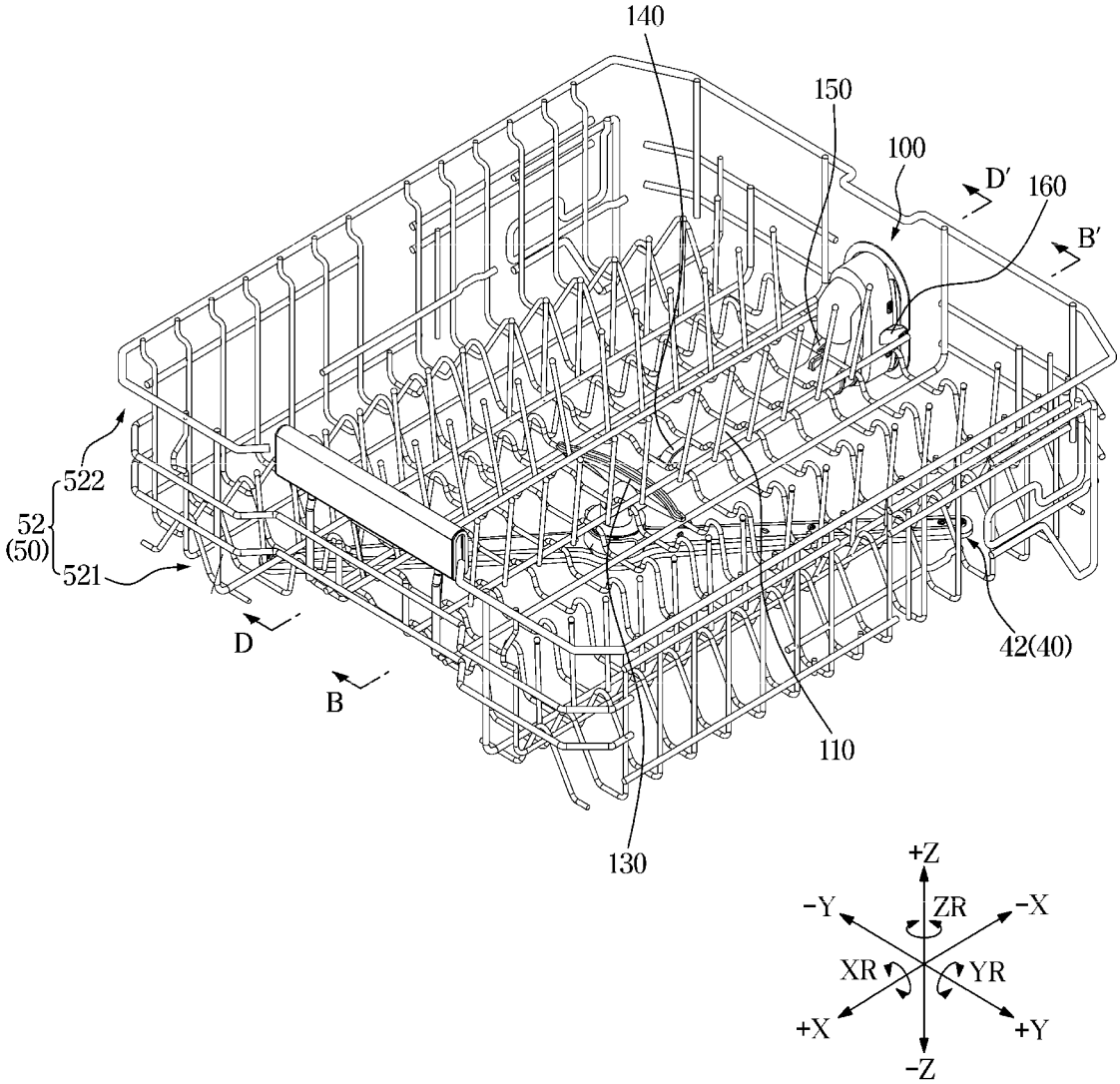
FIG. 3 is a schematic perspective view of an example of some components of the dishwasher according to an embodiment.
Figure 4:
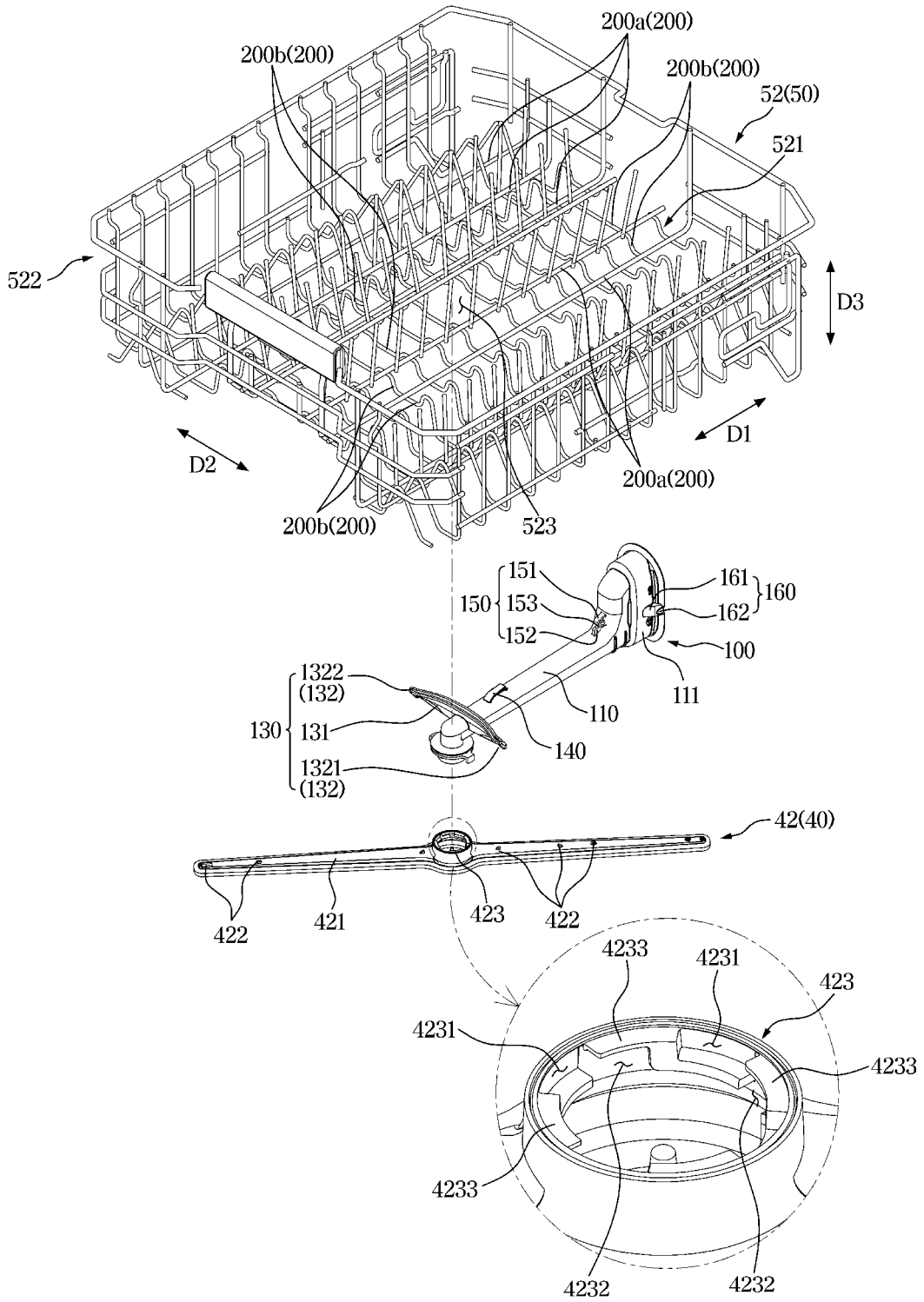
FIG. 4 is an exploded view of some components of the dishwasher illustrated in FIG. 3.
Figure 5:
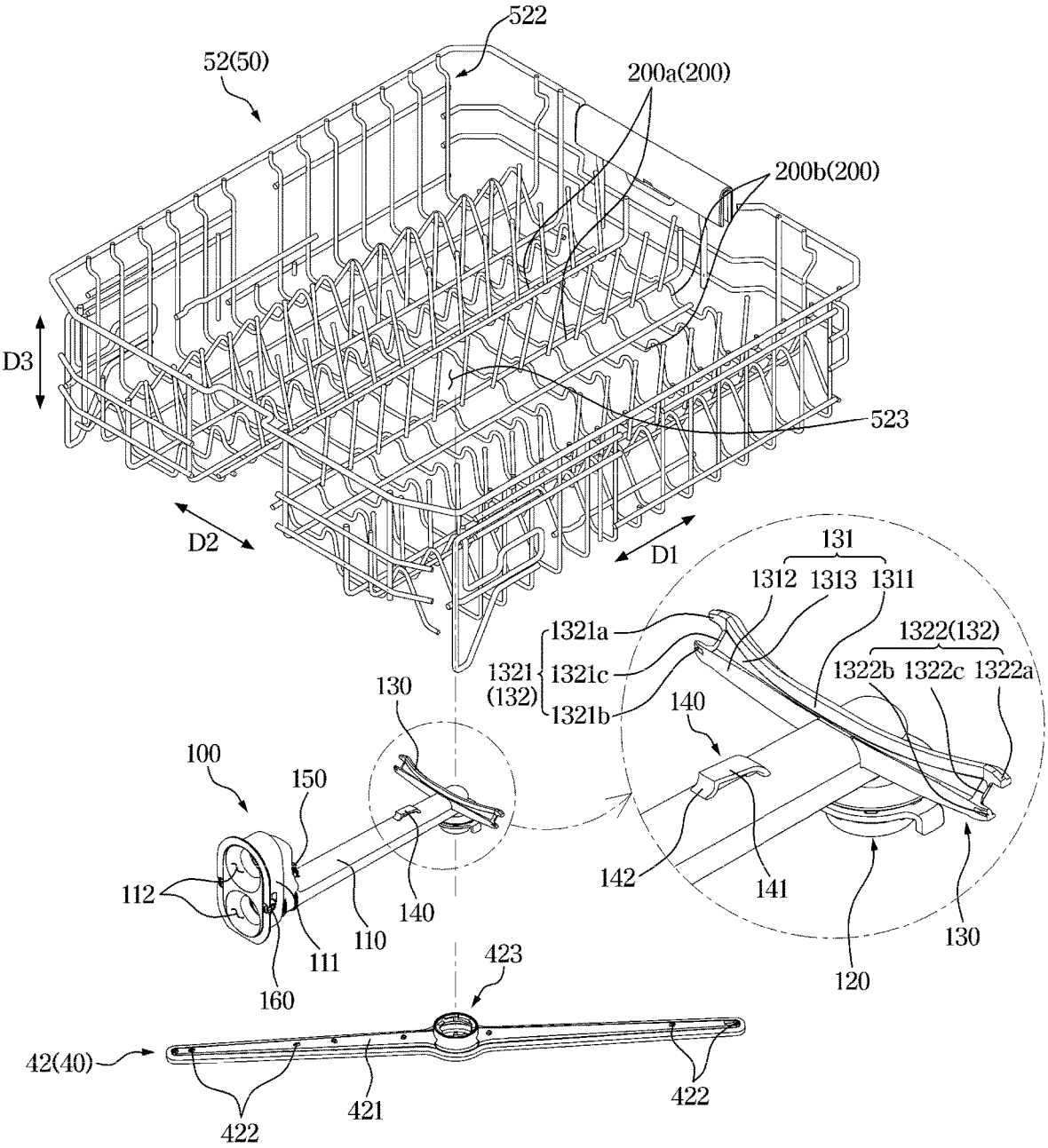
FIG. 5 is an exploded view of some components of the dishwasher illustrated in FIG. 4, which is viewed from another different direction.
Figure 6:
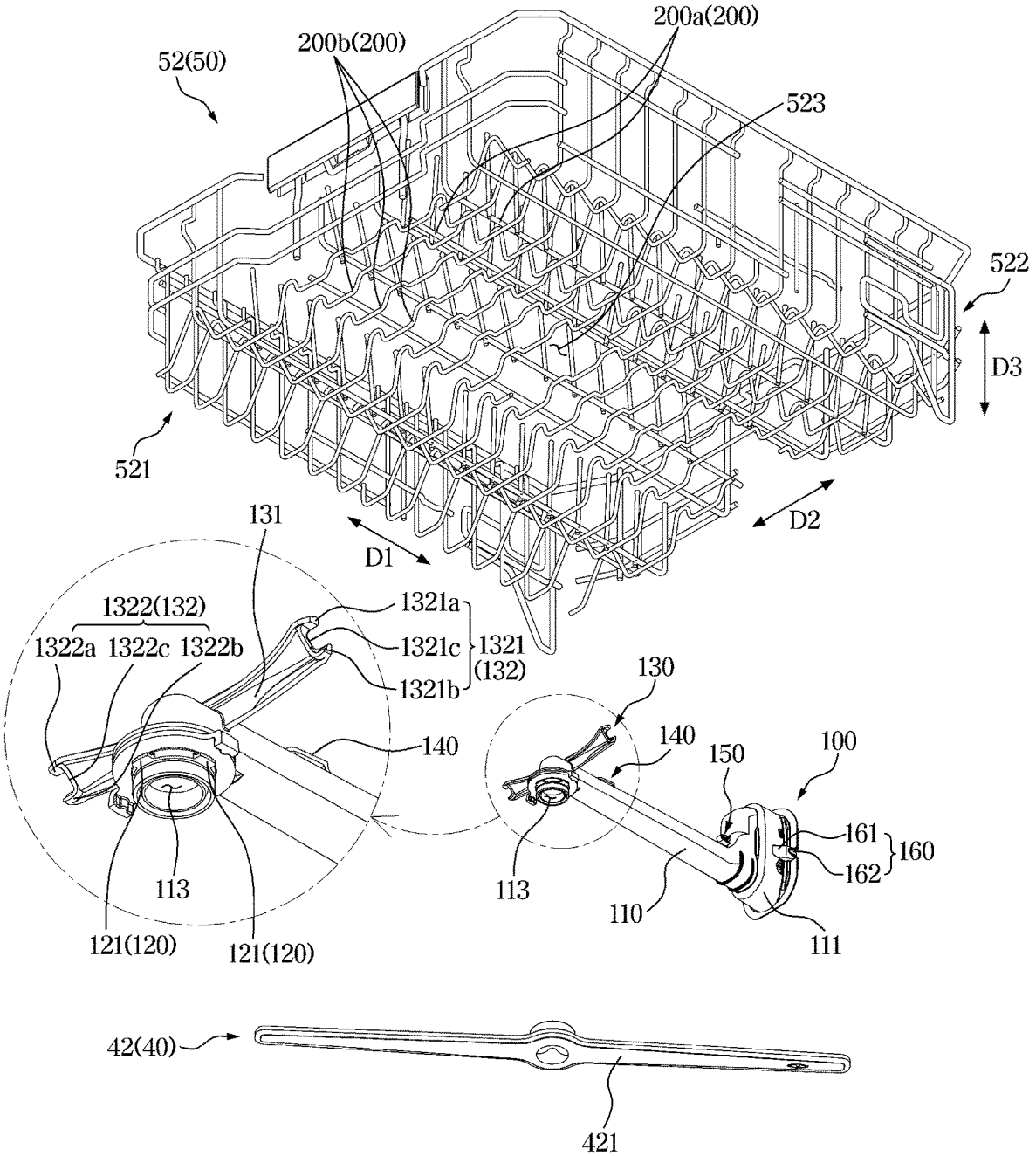
FIG. 6 is an exploded view of some components of the dishwasher illustrated in FIG. 4, which is viewed from another different direction.

FIG. 3 is a schematic perspective view of an example of some components of the dishwasher according to an embodiment. FIG. 4 is an exploded view of some components of the dishwasher illustrated in FIG. 3. FIG. 5 is an exploded view of some components of the dishwasher illustrated in FIG. 4, which is viewed from another different direction. FIG. 6 is an exploded view of some components of the dishwasher illustrated in FIG. 4, which is viewed from another different direction. The same member numbers are assigned to the same components, and detailed descriptions thereof may be omitted.

Hereinafter, the duct 100 will be explained using the second duct 100 as an example, the basket 52 will be explained using the middle basket 52 as an example, and the spray unit 42 will be explained using the second spray unit 42 as an example. However, the present disclosure is not limited to the above-described examples, and it is sufficient for the duct 100 to be configured to guide washing water. It is sufficient for the spray unit 42 to be configured to spray washing water toward dishes. That is, the basket 52, duct 100, and spray unit 42 to be described below are not limited to the examples illustrated in the drawings. For example, the description of the basket 52 below may also apply to the lower basket 51 and/or the upper basket 53. For example, the basket 52 to be described below may also be applied to the lower basket 51 and/or the upper basket 53. For example, the duct 100 to be described below may be applied to a duct (not shown) capable of being coupled to the lower basket 51 and/or a duct (not shown) capable of being coupled to the upper basket 53. For example, the spray unit 42 to be described below may be applied to the first spray unit 41 and/or the third spray unit 42.

The basket 52 may be provided to accommodate dishes. The basket 52 may be provided to store dishes. The basket 52 may be provided to load dishes. The basket 52 may be provided to support dishes. The dishes may be disposed in the washing chamber 10*a* of the tub 12 in a state of being held in the basket 52.

The basket 52 may include a bottom part 521. The bottom part 521 may be provided to support dishes. The bottom part 521 may form a base of the basket 52 to support dishes. For example, the bottom part 521 may be formed in a frame shape by a wire 200, which will be described later. The bottom part 521 may be referred to as the bottom frame 521.

For example, the bottom part 521 may include a plurality of tines. For example, dishes may be held in the basket 52 in a state of being inserted between tines.

The basket 52 may include a side part 522. The side part 522 may be provided to surround the bottom part 521. The side part 522 may have a shape extending upward from an edge of the bottom part 521. For example, the side part 522 may be formed in a frame shape by the wire 200, which will be described later. The side part 522 may be referred to as the side frame 522.

The basket 52 may include the wire 200. The wire 200 may form a frame for supporting dishes. For example, the wire 200 may form an exterior of the basket 52. For example, the wire 200 may form the bottom part 521 of the basket 52. For example, the wire 200 may form the side part 522 of the basket 52. For example, a plurality of the wires 200 may be provided, and the plurality of wires 200 may be formed as the integrated basket 52 through work such as welding or deep drawing.

For example, the bottom part 521 may include a first frame part 200*a* and a second frame part 200*b*. The first frame part 200*a* may be formed by at least one wire having a shape extending along a first direction D1 among the plurality of wires 200. The second frame part 200*b* may be formed by at least one wire having a shape extending along a second direction D2 among the plurality of wires 200. For example, the at least one wire forming the first frame part 200*a* and the at least one wire forming the second frame part 200*b* may be provided to intersect.

For example, at least one of the first frame part 200*a* and the second frame part 200*b* may include a bent shape to secure dishes to the basket 52. The drawings illustrate that the second frame part 200*b* has a shape bent along a third direction D3, but is not limited thereto. For example, the first frame part 200*a* may have a shape bent along the third direction D3. For example, both the first frame part 200*a* and the second frame part 200*b* may have a shape in which a predetermined portion is bent.

For example, the first direction D1 may be substantially the same as the front-rear direction (X direction). For example, the second direction D2 may be substantially the same as the left-right direction (Y direction). For example, the first direction D1 and the second direction D2 may be arranged to intersect. For example, the first direction D1 and the second direction D2 may be arranged to be perpendicular to each other. For example, the third direction D3 may be substantially the same as a vertical direction (Z direction). For example, the third direction D3 may be arranged to intersect the first direction D1 and the second direction D2. However, the present disclosure is not limited to the above-described examples, and in some cases, the first direction D1, the second direction D2, and the third direction D3 may each be defined as various directions.

The basket 52 may include an opening 523. The opening 523 may be provided such that washing water passes therethrough. The opening 523 may be formed by opening a portion of the bottom part 521. The opening 523 may be formed between the plurality of wires 200. As will be described later, the opening 523 may correspond to a first fixing member 130 of the duct 100.

The duct 100 may be provided to guide washing water to be sprayed into dishes. The duct 100 may be provided to deliver washing water to the spray unit 42. The washing water guided by the duct 100 may be sprayed into the dishes through the spray unit 42 connected to the duct 100.

The duct 100 may be detachably coupled to the basket 52. The duct 100 may be detachably mounted on the basket 52. The duct 100 may be provided to fix the wire 200 of the basket 52.

The duct 100 may include a duct body 110. The duct body 110 may form a flow path 110*f* (see FIG. 12) through which washing water flows. The duct body 110 may be disposed to extend along the first direction D1 in a state in which the duct 100 is coupled to the basket 52. For example, the duct body 110 may be disposed to extend substantially along the front-rear direction (X direction).

For example, the duct body 110 may include a connection part 111. The connection part 111 may be connected to a component that receives washing water from the sump 70 (for example, the first duct 14 (see FIG. 2)). However, the present disclosure is not limited thereto, and for example, the connection part 111 may be directly connected to the sump 70.

The duct body 110 may include an inlet 112 into which washing water is introduced. For example, the inlet 112 may be provided to communicate with the first duct 14 (see FIG. 2). However, the present disclosure is not limited thereto, and for example, the inlet 112 may be connected to the sump 70 to receive washing water directly from the sump 70.

The duct body 110 may include an outlet 113 through which washing water flows out. The outlet 113 may be provided to communicate with the spray unit 42. However, the present disclosure is not limited thereto, and for example, the outlet 113 may be provided to spray washing water directly toward dishes.

For example, the inlet 112 may be formed on one side of the duct body 110, and the outlet 113 may be formed on the other side of the duct body 110.

The duct 100 may include at least one fixing member fixed to the basket 52. The fixing member may fix the wire 200 of the basket 52. As the fixing member fixes the wire 200, the duct 100 may be stably mounted on the basket 52. As the fixing member fixes the wire 200, the duct 100 may be stably suspended in the basket 52. As the fixing member fixes the wire 200, the shaking of the basket 52 may be prevented and/or reduced.

The duct 100 may include the first fixing member 130. The first fixing member 130 may be formed on the duct body 110. For example, the first fixing member 130 may be formed at an upper portion of the duct body 110. For example, the first fixing member 130 may be formed in a front portion of the duct body 110. For example, the first fixing member 130 may be formed on a side adjacent to the outlet 113 of the duct body 110.

The first fixing member 130 may include an extension body 131. The extension body 131 may extend from the duct body 110. The extension body 131 may extend in a direction intersecting an extension direction of the duct body 110. The extension body 131 may be disposed to extend along the second direction D2 that intersects the first direction D1 in the state in which the duct 100 is coupled to the basket 52. For example, the extension body 131 may be disposed to extend substantially along the left-right direction (Y direction).

For example, the extension body 131 may include a first extension body 1311 (see FIG. 5). The first extension body 1311 may extend to connect a first fixing protrusion 1321*a* of a first fixing part 1321 and a third fixing protrusion 1322*a* of a second fixing part 1322, which will be described later.

For example, the extension body 131 may include a second extension body 1312 (see FIG. 5). The second extension body 1312 may extend to connect a second fixing protrusion 1321*b* of the first fixing part 1321 and a fourth fixing protrusion 1322*b* of the second fixing part 1322, which will be described later.

For example, the extension body 131 may include a connection body 1313 (see FIG. 5). The connection body 1313 may extend to connect the first extension body 1311 and the second extension body 1312.

The drawing illustrates that the first extension body 1311 has a curved shape and the second extension body 1312 has a straight shape, but the present disclosure is not limited thereto. For example, the second extension body 1312 may have a curved shape, and the first extension body 1311 may have a straight shape. For example, both the first extension body 1311 and the second extension body 1312 may have a curved shape. For example, both the first extension body 1311 and the second extension body 1312 may have a straight shape. The extension body 131 may have various shapes to connect the first fixing part 1321 and the second fixing part 1322.

The first fixing member 130 may include a fixing part 132. The fixing part 132 may be detachably coupled to the bottom part 521 of the basket 52. The fixing part 132 may be provided to fix the wire 200 forming the bottom part 521.

For example, the fixing parts 132 may be provided on opposite sides of the extension body 131, respectively. For example, the fixing parts 132 may be provided at opposite ends of the extension body 131, respectively. For example, the fixing part 132 may include the first fixing part 1321 formed on one side of the extension body 131. For example, the fixing part 132 may include the second fixing part 1322 formed on the other side of the extension body 131.

For example, the first fixing part 1321 and the second fixing part 1322 may be provided as a pair. The first fixing part 1321 may be symmetrical to the second fixing part 1322. The first fixing part 1321 may have the same shape as the second fixing part 1322. The first fixing part 1321 and the second fixing part 1322 may be spaced apart from each other along the second direction D2. The first fixing part 1321 and the second fixing part 1322 may be spaced apart from each other substantially along the left-right direction Y.

The first fixing part 1321 may include the first fixing protrusion 1321*a* and the second fixing protrusion 1321*b* spaced apart from the first fixing protrusion 1321*a*. For example, the second fixing protrusion 1321*b* may be spaced apart from the first fixing protrusion 1321*a* along the first direction D1. For example, the second fixing protrusion 1321*b* may be spaced apart from the first fixing protrusion 1321*a* along the third direction D3.

The first fixing part 1321 may include a first fixing groove 1321*c*. The first fixing groove 1321*c* may be formed between the first fixing protrusion 1321*a* and the second fixing protrusion 1321*b*. The first fixing groove 1321*c* may be formed by being recessed between the first fixing protrusion 1321*a* and the second fixing protrusion 1321*b*.

The second fixing part 1322 may include the third fixing protrusion 1322*a* and the fourth fixing protrusion 1322*b* spaced apart from the third fixing protrusion 1322*a*. For example, the fourth fixing protrusion 1322*b* may be spaced apart from the third fixing protrusion 1322*a* along the first direction D1. For example, the fourth fixing protrusion 1322*b* may be spaced apart from the third fixing protrusion 1322*a* along the third direction D3.

For example, the third fixing protrusion 1322*a* may be spaced apart from the first fixing protrusion 1321*a* along the second direction D2. For example, the fourth fixing protrusion 1322*b* may be spaced apart from the second fixing protrusion 1321*b* along the second direction D2.

The second fixing part 1322 may include a second fixing groove 1322*c*. The second fixing groove 1322*c* may be formed between the third fixing protrusion 1322*a* and the fourth fixing protrusion 1322*b*. The second fixing groove 1322*c* may be formed by being recessed between the third fixing protrusion 1322*a* and the fourth fixing protrusion 1322*b*.

The duct 100 may include a second fixing member 140. The second fixing member 140 may be formed on the duct body 110. For example, the second fixing member 140 may be formed at the upper portion of the duct body 110. For example, the second fixing member 140 may be spaced apart from the first fixing member 130 along the extension direction of the duct body 110. For example, the second fixing member 140 may be disposed at the rear of the first fixing member 130.

For example, the second fixing member 140 may include a hook. The second fixing member 140 may be referred to as the hook 140.

For example, the second fixing member 140 may include a hook body 141 extending from the upper portion of the duct body 110. The hook body 141 may be provided to form a predetermined distance from the duct body 110. For example, the second fixing member 140 may include a hook protrusion 142 formed at an end of the hook body 141.

The duct 100 may include a third fixing member 150. The third fixing member 150 may be formed on the duct body 110. For example, the third fixing member 150 may be formed on the upper portion of the duct body 110. For example, the third fixing member 150 may be spaced apart from the first fixing member 130 along the extension direction of the duct body 110. For example, the third fixing member 150 may be spaced apart from the second fixing member 140 along the extension direction of the duct body 110. For example, the third fixing member 150 may be disposed at the rear of the first fixing member 130. For example, the third fixing member 150 may be disposed at the rear of the second fixing member 140.

For example, the third fixing member 150 may include a fifth fixing protrusion 151. For example, the third fixing member 150 may include a sixth fixing protrusion 152 spaced apart from the fifth fixing protrusion 151. For example, the third fixing member 150 may include a third fixing groove 153 formed between the fifth fixing protrusion 151 and the sixth fixing protrusion 152. For example, the fifth fixing protrusion 151, the sixth fixing protrusion 152, and the third fixing groove 153 may be arranged along the third direction D3. However, the present disclosure is not limited thereto, and the fifth fixing protrusion 151, the sixth fixing protrusion 152, and the third fixing groove 153 may be arranged along the first direction D1 or the second direction D2.

The duct 100 may include a fourth fixing member 160. The fourth fixing member 160 may be formed on the duct body 110. For example, the fourth fixing member 160 may be formed on a side of the connection part 111. For example, the fourth fixing members 160 may be provided on opposite sides of the connection part 111, respectively. For example, the fourth fixing member 160 may include a right fixing member 160*a* provided on the right side of the connection part 111 and a left fixing member 160*b* provided on the left side of the connection part 111.

For example, the fourth fixing member 160 may include a support part 161 provided to protrude laterally from the connection part 111. For example, the fourth fixing member 160 may include a support groove 162 formed by recessing of a portion of the support part 161. For example, each of the right fixing member 160*a* and the left fixing member 160*b* may include the support part 161 and the support groove 162.

The duct 100 may include a first coupling part 120. The first coupling part 120 may be provided to be able to be coupled with the spray unit 42. The first coupling part 120 may be coupled with a second coupling part 423 of the spray unit 42. For example, the first coupling part 120 may be rotationally coupled to the second coupling part 423.

For example, the first coupling part 120 may include a coupling protrusion 121. For example, a plurality of the coupling protrusions 121 may be provided, and the plurality of coupling protrusions 121 may be arranged to be spaced apart from each other around the outlet 113.

The spray unit 42 may be provided to spray washing water guided by the duct 100 toward dishes. The spray unit 42 may be provided to spray washing water guided by the duct 100 into the washing chamber 10*a*. The spray unit 42 may be provided to enable communication with the duct 110. The spray unit 42 may be provided to enable communication with the outlet 113 of the duct 100.

For example, the spray unit 42 may be provided to be rotatable with respect to the duct 100. The spray unit 42 may spray washing water while rotating with respect to the duct 100. The spray unit 42 may be referred to as the spray rotor 42.

The spray unit 42 may include a rotor body 421. The rotor body 421 may have a shape extending in one direction. The rotor body 421 may form a flow path through which washing water flows.

The spray unit 42 may include a spray hole 422 for spraying washing water. The spray hole 422 may be formed in the rotor body 421. For example, a plurality of the spray holes 422 may be provided. For example, the plurality of spray holes 422 may be arranged to be spaced apart from each other along an extension direction of the rotor body 421.

The spray unit 42 may include the second coupling part 423. The second coupling part 423 may be provided to be able to be coupled with the duct 100. The second coupling part 423 may be coupled with the first coupling part 120 of the duct 100. For example, the second coupling part 423 may be rotationally coupled to the first coupling part 120.

For example, the second coupling part 423 may include a coupling groove portion corresponding to the coupling protrusion 121. For example, the coupling groove portion may include a first coupling groove 4231, a second coupling groove 4232, and a stopper 4233. For example, the coupling groove portion may be provided in a substantially rail shape, and the coupling protrusion 121 may be inserted into the first coupling groove 4231 to be guided to the second coupling groove 4232. For example, the stopper 4233 may prevent the coupling protrusion 121 from being separated from the coupling groove portion in a state in which the coupling protrusion 121 is provided in the second coupling groove 4232.

The duct 100 and the spray unit 42 may be referred to as a guide assembly.

The drawing illustrates that the duct 100 and the spray unit 42 are separate components, but the present disclosure is not limited thereto. The duct 100 and the spray unit 42 may be integrally formed.

Figure 7:
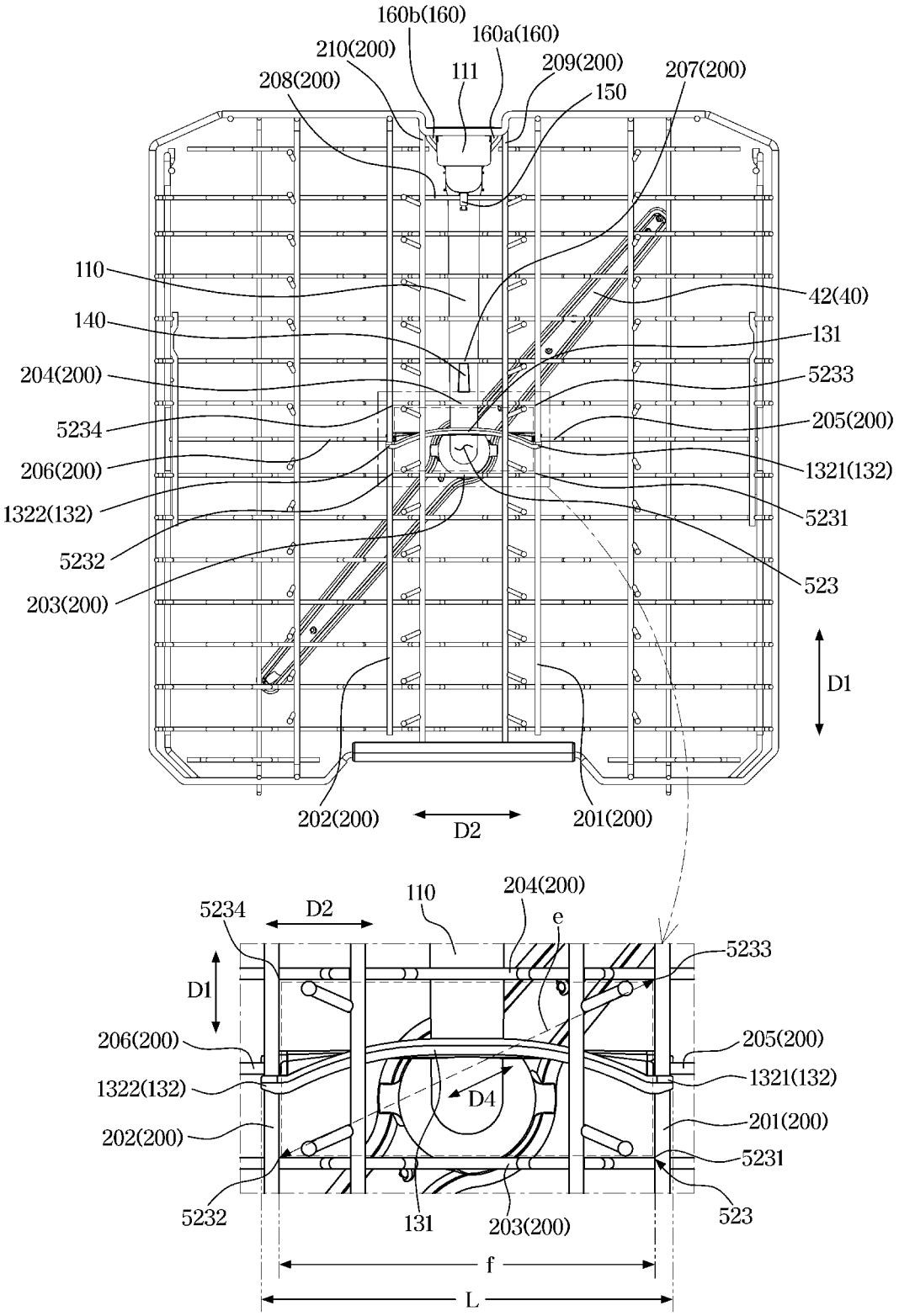
FIG. 7 is a top view of some components of the dishwasher illustrated in FIG. 3.
Figure 8:
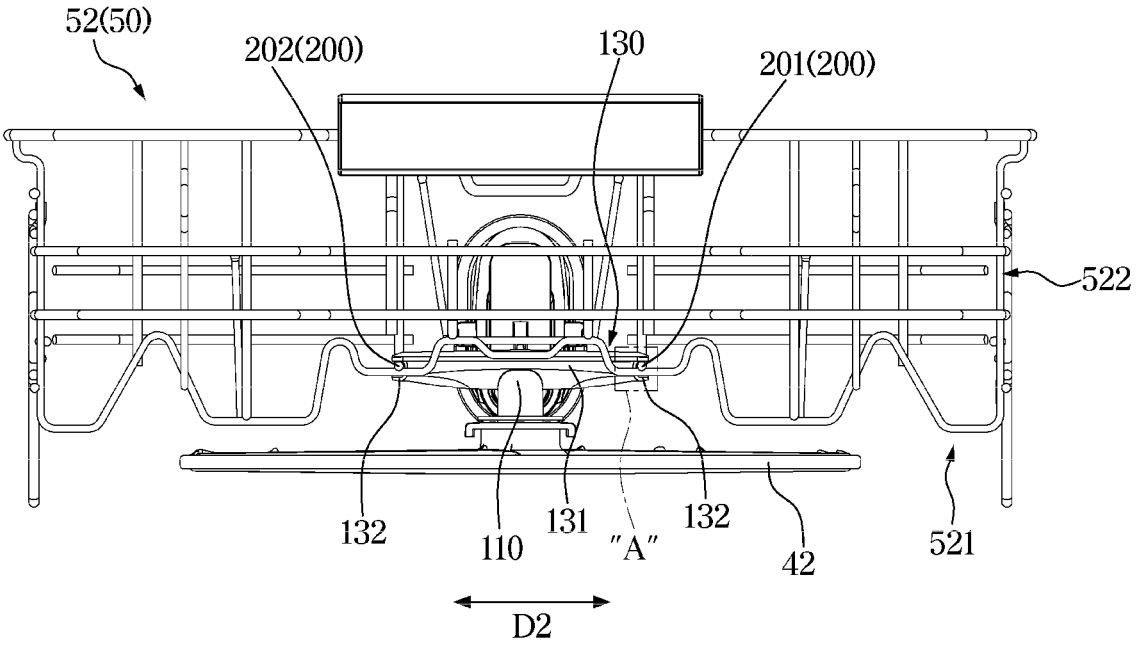
FIG. 8 is a front view of some components of the dishwasher illustrated in FIG. 3.
Figure 9:
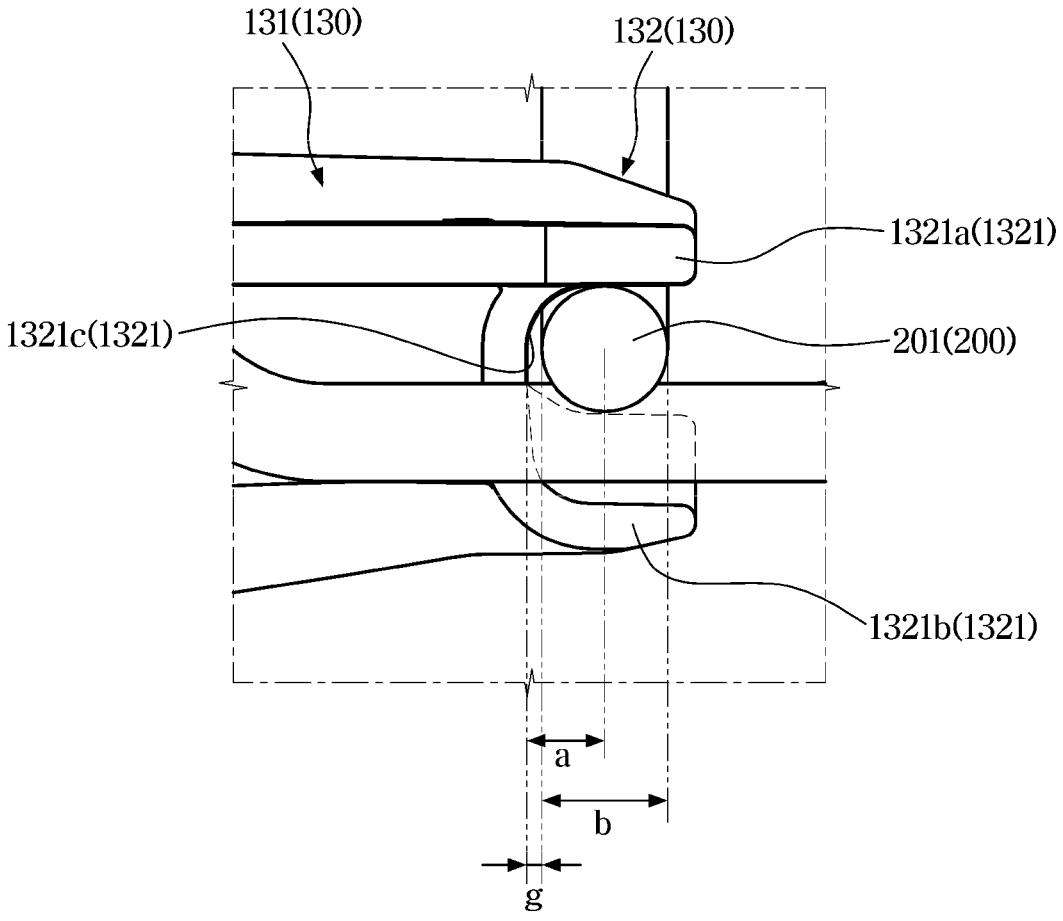
FIG. 9 is an enlarged view of part A indicated in FIG. 8.
Figure 10:
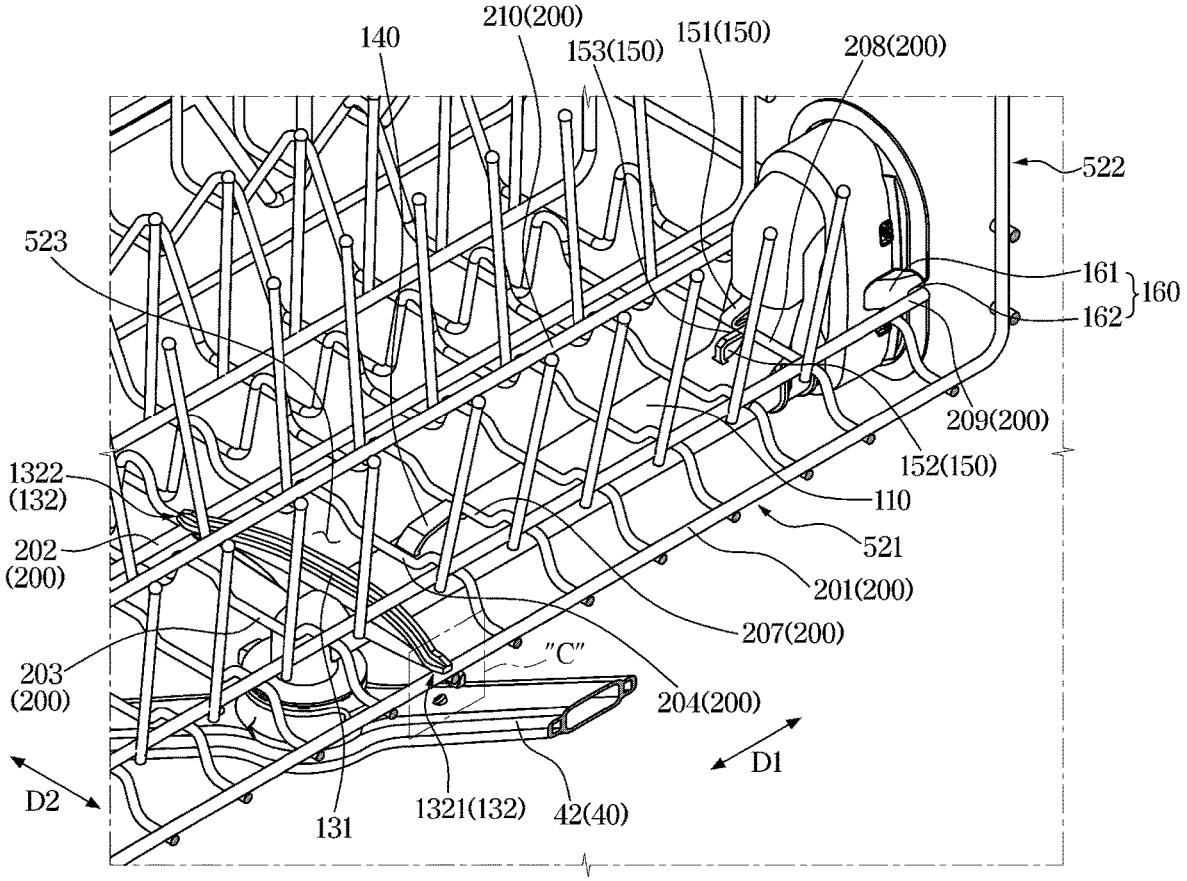
FIG. 10 is a view cut along a line B-B' indicated in FIG. 3.
Figure 11:
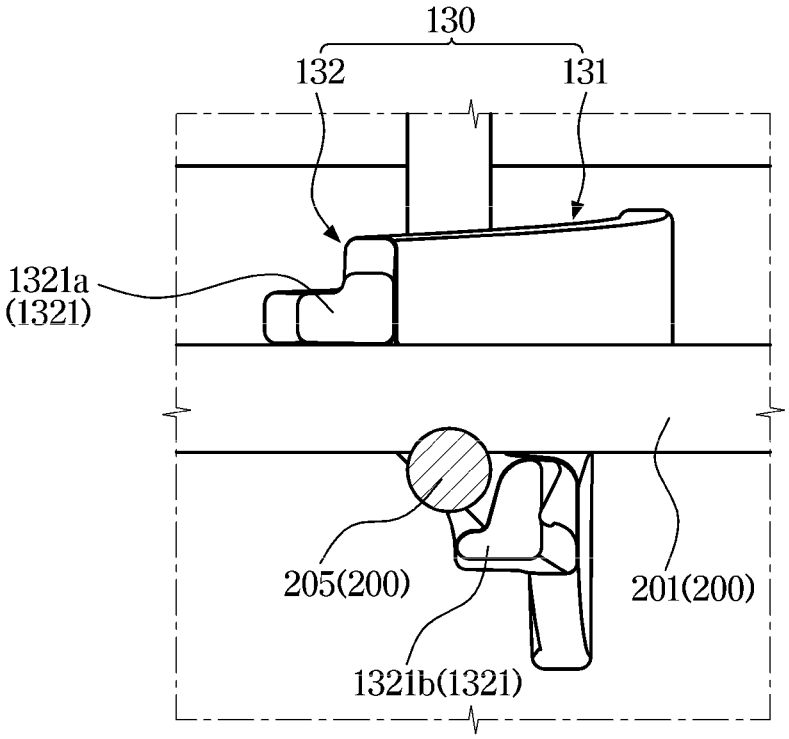
FIG. 11 is an enlarged view of part C indicated in FIG. 10.
Figure 12:
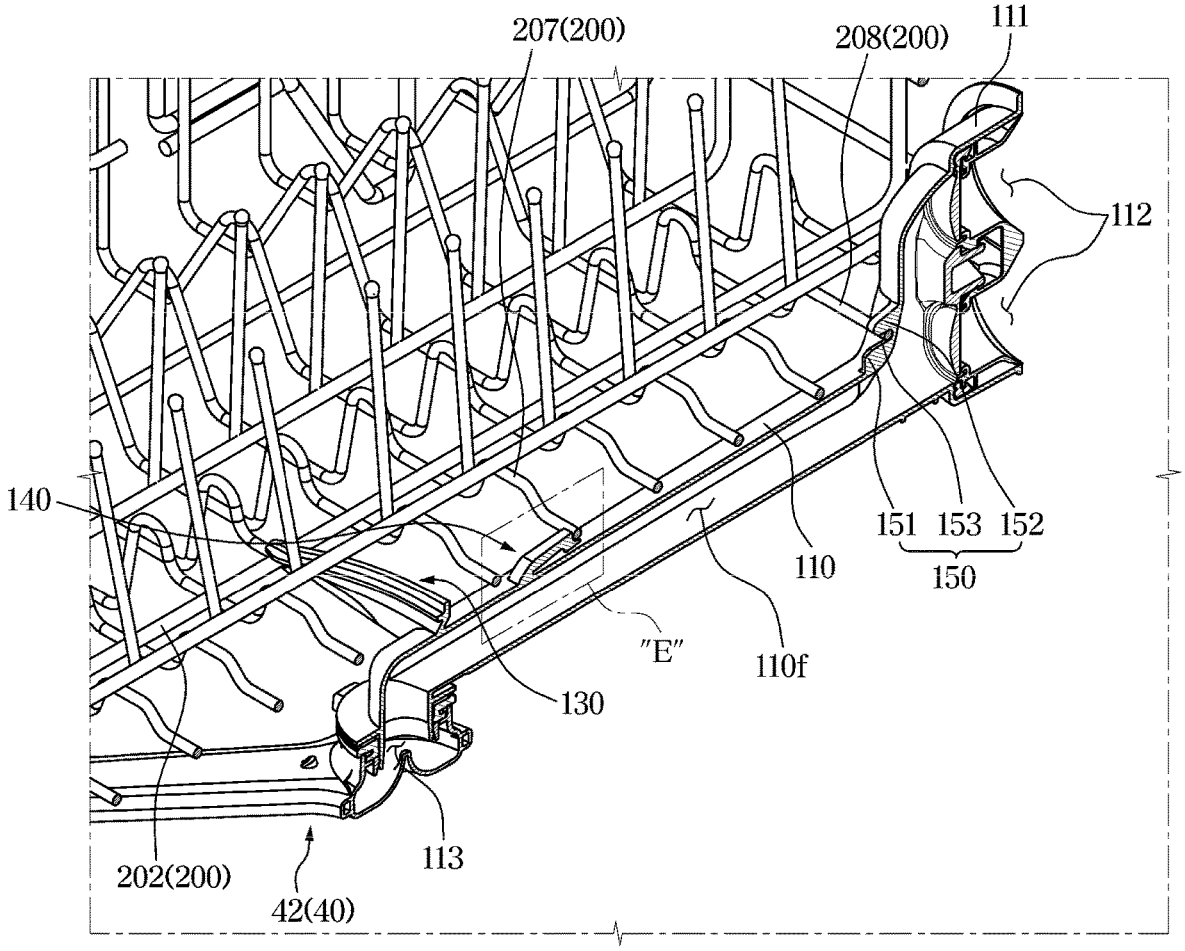
FIG. 12 is a view cut along a line D-D' indicated in FIG. 3.
Figure 13:
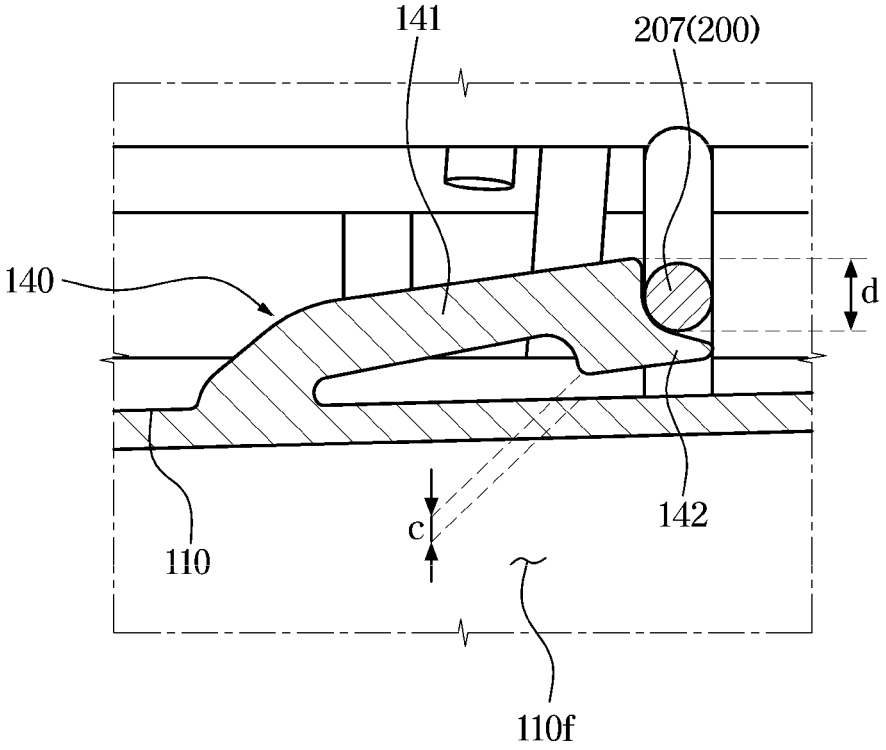
FIG. 13 is an enlarged view of part E indicated in FIG. 12.

FIG. 7 is a top view of some components of the dishwasher illustrated in FIG. 3. FIG. 8 is a front view of some components of the dishwasher illustrated in FIG. 3. FIG. 9 is an enlarged view of part A indicated in FIG. 8. FIG. 10 is a view cut along a line B-B' indicated in FIG. 3. FIG. 11 is an enlarged view of part C indicated in FIG. 10. FIG. 12 is a view cut along a line D-D' indicated in FIG. 3. FIG. 13 is an enlarged view of part E indicated in FIG. 12. The same member numbers are assigned to the same components, and detailed descriptions thereof may be omitted.

Referring to FIGS. 7 to 13, the duct 100 may be provided to fix the at least one wire 200 forming the basket 52. For example, the first fixing member 130 may fix wires 201 and 202. For example, the second fixing member 140 may be provided to fix a wire 207. For example, the third fixing member 150 may be provided to fix a wire 208. For example, the fourth fixing member 160 may be provided to fix wires 209 and 210.

The first fixing member 130 may be disposed to correspond to the opening 523 of the basket 52. The first fixing member 130 may be provided to fix at least one of the wires 201 and 202 form the opening 523 and extending in the first direction D1.

For example, the duct 100 may be coupled to the basket 52 by rotating with respect to the basket 52 in a state in which the first fixing member 130 is placed in the opening 523. For example, as the duct 100 rotates with respect to the basket 52 in a state in which the extension body 131 is placed in the opening 523, the first fixing member 130 may be coupled to the wires 201 and 202. A detailed explanation of this will be provided later.

For example, the opening 523 may be formed as the first frame part 200*a* and the second frame part 200*b* intersect. For example, the opening 523 may be formed by the first wire 201, the second wire 202, a third wire 203, and a fourth wire 204. However, the present disclosure is not limited thereto, and the opening 523 may be formed by various combinations of the wires 200.

For example, the first wire 201 may extend along the first direction D1. For example, the first wire 201 may be provided as one configuration of the first frame part 200*a*.

For example, the second wire 202 may extend along the first direction D1. For example, the second wire 202 may be spaced apart from the first wire 201 along the second direction D2. For example, the second wire 202 may be provided as one configuration of the first frame part 200*a*.

For example, the third wire 203 may extend along the second direction D2. For example, the third wire 203 may be provided to connect the first wire 201 and the second wire 202. For example, the third wire 203 may be provided as one configuration of the second frame part 200*b*.

For example, the fourth wire 204 may extend along the second direction D2. For example, the fourth wire 204 may be provided to connect the first wire 201 and the second wire 202. For example, the fourth wire 204 may be spaced apart from the third wire 203 along the first direction D1. For example, the fourth wire 204 may be provided as one configuration of the second frame part 200*b*.

For example, the opening 523 may include a substantially square shape. For example, the opening 523 may include a first corner 5231, a second corner 5232, a third corner 5233, and a fourth corner 5234. The first corner 5231 may be formed at a point where the first wire 201 and the third wire 203 intersect. The second corner 5232 may be formed at a point where the second wire 202 and the third wire 203 intersect. The third corner 5233 may be formed at a point where the first wire 201 and the fourth wire 204 intersect. The fourth corner 5234 may be formed at a point where the second wire 202 and the fourth wire 204 intersect. However, as described above, the opening 523 may have various shapes by various combinations of the wires 200.

For example, as a portion of a wire disposed between the third wire 203 and the fourth wire 204 to extend along the second direction D2 is cut, an opening 253 may be formed. For example, as a portion of a wire disposed between the third wire 203 and the fourth wire 204 to extend along the second direction D2 is cut, only a fifth wire 205 and a sixth wire 206 may remain. However, the present disclosure is not limited to the above-described examples. As an example, the fifth wire 205 may be welded to the first wire 201, and the sixth wire 206 may be welded to the second wire 202. For example, the fifth wire 205 and the sixth wire 206 may be omitted.

The extension body 131 of the first fixing member 130 may be disposed to extend substantially in the second direction D2 on the opening 253 (see FIG. 7). For example, the extension body 131 of the first fixing member 130 may be disposed to be substantially in line with the fifth wire 205. For example, the extension body 131 of the first fixing member 130 may be disposed to be substantially in line with the sixth wire 206. For example, the extension body 131 may appear as one configuration of the wire 200 in the state in which the duct 100 is coupled to the basket 52. Accordingly, the wire 200 and the extension body 131 may form a uniform frame shape.

For example, an extension length L of the first fixing member 130 may be shorter than a length e of the opening 253 in a fourth direction D4 (see FIG. 7). For example, an extension length of the extension body 131 may be shorter than the length e of the opening 253 in the fourth direction D4. As will be described later, the first fixing member 130 may be disposed to extend along a diagonal direction of the opening 523 in the process of assembling the duct 100 to the basket 52 (see FIG. 15). The fourth direction D4 may refer to the diagonal direction of the opening 253. In the drawing, the fourth direction D4 is indicated as a diagonal extension direction of connecting the second corner 5232 and the third corner 5233 of the opening 253, but the present disclosure is not limited thereto. The fourth direction D4 may be indicated as a diagonal extension direction of connecting the first corner 5231 and the fourth corner 5234 of the opening 253.

For example, a distance between the first fixing groove 1321*c* and the second fixing groove 1322*c* may be equal to or shorter than a length f of the opening 253 in the second direction D2 (see FIG. 7). As will be described later, as the first fixing member 130 is inserted between the first wire 201 and the second wire 202, a wire fixing force of the first fixing member 130 may be increased.

The first fixing part 1321 of the first fixing member 130 may fix the first wire 201. The first fixing part 1321 may be able to be coupled with the first wire 201.

The first fixing protrusion 1321*a* of the first fixing part 1321 may be provided to fix an upper portion of the first wire 201 (see FIGS. 8 to 11). The second fixing protrusion 1321*b* of the first fixing part 1321 may be provided to fix a lower portion of the first wire 201 (see FIGS. 8 to 11). Accordingly, the first fixing part 1321 may be provided to hold the first wire 201 substantially in the up-down direction (Z direction).

The second fixing protrusion 1321*b* of the first fixing part 1321 may be spaced apart from the first fixing protrusion 1321*a* along an extension direction of the first wire 201 (see FIGS. 10 and 11). The second fixing protrusion 1321*b* may be spaced apart from the first fixing protrusion 1321*a* along the first direction D1. The second fixing protrusion 1321*b* may fix the second wire 202 in a state of being spaced apart from the first fixing protrusion 1321*a* substantially in the front-rear direction (X direction). Accordingly, the first fixing part 1321 may be provided to hold the first wire 201 substantially in the front-rear direction (X direction).

The drawing illustrates that the second fixing protrusion 1321*b* is disposed at the rear of the first fixing protrusion 1321*a*, but the present disclosure is not limited thereto. The second fixing protrusion 1321*b* may be disposed in front of the first fixing protrusion 1321*a*.

The first fixing groove 1321*c* of the first fixing part 1321 may be formed between the first fixing protrusion 1321*a* and the second fixing protrusion 1321*b* to accommodate the first wire 201.

For example, the first fixing protrusion 1321*a* and the second fixing protrusion 1321*b* may be provided to protrude further than the first wire 201 along the second direction D2 (see FIGS. 8 and 9). A protrusion length of the first fixing protrusion 1321*a* from the first fixing groove 1321*c* may be longer than a diameter b of the first wire 201. A protrusion length of the second fixing protrusion 1321*b* from the first fixing groove 1321*c* may be longer than the diameter b of the first wire 201.

For example, a distance a between the first fixing groove 1321*c* and a center of the first wire 201 may be shorter than the diameter b of the first wire 201 (see FIGS. 8 and 9). For example, a gap g formed between the first fixing groove 1321*c* and the first wire 201 may be smaller than the diameter b of the first wire 201. For example, the gap g formed between the first fixing groove 1321*c* and the first wire 201 is formed to be relatively small compared to the diameter b of the first wire 201, and thus the rigidity of the first fixing member 131 may not be significantly reduced.

The second fixing part 1322 of the first fixing member 130 may fix the second wire 202. The second fixing part 1322 may be able to be coupled with the second wire 202. For example, the method in which the first fixing part 1321 fixes the first wire 201 as described above may be applied equally to a method in which the second fixing part 1322 fixes the second wire 202.

The third fixing protrusion 1322*a* of the second fixing part 1322 may be provided to fix an upper portion of the second wire 202. The fourth fixing protrusion 1322*b* of the second fixing part 1322 may be provided to fix a lower portion of the second wire 202. Accordingly, the second fixing part 1322 may be provided to hold the second wire 202 substantially in the up-down direction (Z direction).

The fourth fixing protrusion 1322*b* of the second fixing part 1322 may be spaced apart from the third fixing protrusion 1322*a* along an extension direction of the second wire 202. The fourth fixing protrusion 1322*b* may be spaced apart from the third fixing protrusion 1322*a* along the first direction D1. The fourth fixing protrusion 1322*b* may fix the second wire 202 in a state of being substantially spaced apart from the third fixing protrusion 1322*a* substantially in the front-rear direction (X direction). Accordingly, the second fixing part 1322 may be provided to hold the second wire 202 substantially in the front-rear direction (X direction).

The drawing illustrates that the fourth fixing protrusion 1322*b* is disposed at the rear of the third fixing protrusion 1322*a*, but the present disclosure is not limited thereto. The fourth fixing protrusion 1322*b* may be disposed in front of the third fixing protrusion 1322*a*.

The second fixing groove 1322*c* of the second fixing part 1322 may be formed between the third fixing protrusion 1322*a* and the fourth fixing protrusion 1322*b* to accommodate the second wire 202.

For example, the third fixing protrusion 1322*a* and the fourth fixing protrusion 1322*b* may be provided to protrude further than the second wire 202 along the second direction D2. A protrusion length of the third fixing protrusion 1322*a* from the second fixing groove 1322*c* may be longer than a diameter of the second wire 202. A protrusion length of the fourth fixing protrusion 1322*b* from the second fixing groove 1322*c* may be longer than the diameter of the second wire 202.

For example, a distance between the second fixing groove 1322*c* and a center of the second wire 202 may be shorter than the diameter of the second wire 202. For example, a gap formed between the second fixing groove 1322*c* and the second wire 202 may be smaller than the diameter of the second wire 202. For example, the gap formed between the second fixing groove 1322*c* and the second wire 202 is formed to be relatively small compared to the diameter of the second wire 202, and thus the rigidity of the first fixing member 131 may not be significantly reduced.

The first fixing part 1321 and the second fixing part 1322 may be provided to fix the first wire 201 and the second wire 202 on opposite sides of the extension body 132, respectively. Accordingly, the first fixing member 1321 may be provided to hold the basket 52 substantially in the left-right direction (Y direction).

The second fixing member 140 may fix the seventh wire 207. The second fixing member 140 may be able to be coupled with the seventh wire 207.

For example, the seventh wire 207 may extend along the second direction D2. For example, the seventh wire 207 may be provided as one configuration of the second frame part 200*b*. For example, the seventh wire 207 may be spaced apart from the third wire 203 along the first direction D1. For example, the seventh wire 207 may be spaced apart from the fourth wire 204 along the first direction D1. For example, the seventh wire 207 may be disposed at the rear of the third wire 203. For example, the seventh wire 207 may be disposed at the rear of the fourth wire 204.

The second fixing member 140 may include the hook body 141 and the hook protrusion 142. The hook protrusion 142 may be coupled with the seventh wire 207. The hook protrusion 142 may be provided to interfere with the seventh wire 207. The hook protrusion 142 may be provided to be in close contact with the seventh wire 207. The hook protrusion 142 may be provided to be in contact with the seventh wire 207.

For example, in the state in which the duct 100 is coupled to the basket 52, a distance c between a lower end of the hook protrusion 142 and the upper portion of the duct body 110 may be shorter than a distance d between an upper end of the hook protrusion 142 and a lower end of the seventh wire 207 (see FIG. 13). For example, the distance c that the hook projection 142 is able to move in the up-down direction is shorter than the distance d that the hook projection 142 needs to move in the up-down direction to release the contact with the seventh wire 207. Accordingly, even when a downward force is applied to the hook body 141, the coupling between the hook protrusion 142 and the seventh wire 207 may not be easily released.

The third fixing member 150 may fix the eighth wire 208. The third fixing member 150 may be able to be coupled with the eighth wire 208.

For example, the eighth wire 208 may extend along the second direction D2. For example, the eighth wire 208 may be provided as one configuration of the second frame part 200*b*. For example, the eighth wire 208 may be spaced apart from the seventh wire 207 along the first direction D1. For example, the eighth wire 208 may be disposed at the rear of the seventh wire 207.

For example, the third fixing member 150 may include the fifth fixing protrusion 151, the sixth fixing protrusion 152, and the third fixing groove 153 formed between the fifth fixing protrusion 151 and the sixth fixing protrusion 152. The third fixing groove 153 may be provided to fix the eighth wire 208. The eighth wire 208 may be inserted into the third fixing groove 153.

The fourth fixing member 160 may fix the ninth wire 209 and the tenth wire 210. For example, the right fixing member 160*a* may fix the ninth wire 209. For example, the right fixing member 160*a* may be able to be coupled with the ninth wire 209. For example, the left fixing member 160*b* may fix the tenth wire 210. For example, the left fixing member 160*b* be able to be coupled with the tenth wire 210.

For example, the ninth wire 209 may extend along the first direction D1. For example, the ninth wire 209 may be provided as one configuration of the first frame part 200*a*. For example, the tenth wire 210 may extend along the first direction D1. For example, the tenth wire 210 may be provided as one configuration of the first frame part 200*a*. For example, the tenth wire 210 may be spaced apart from the ninth wire 209 along the second direction D2. For example, the ninth wire 209 may be disposed between the first wire 201 and the second wire 202. For example, the tenth wire 210 may be disposed between the first wire 201 and the second wire 202.

For example, the support groove 162 of the right fixing member 160*a* may be provided to interfere with the ninth wire 209. For example, the support groove 162 of the right fixing member 160*a* may be provided to be in contact with the ninth wire 209. For example, the support groove 162 of the left fixing member 160*b* may be provided to interfere with the tenth wire 210. For example, the support groove 162 of the left fixing member 160*b* may be provided to be in contact with the tenth wire 210.

The duct 100 may hold the basket 52 substantially in the first direction D1. The duct 100 may hold the basket 52 substantially in the front-rear direction (X direction). For example, the second fixing member 140 and the third fixing member 150 may fix the seventh wire 207 and the eighth wire 208, respectively, in a state of being spaced apart substantially in the first direction D1. Accordingly, the duct 100 may prevent the basket 52 from moving along the first direction D1 in the state of being coupled to the basket 52. In addition, the duct 100 may be maintained aligned with the basket 52 in the first direction D1 in the state of being coupled to the basket 52.

The duct 100 may hold the basket 52 substantially in the second direction D2. The duct 100 may hold the basket 52 substantially in the left-right direction (Y direction). For example, the first fixing part 1321 and the second fixing part 1322 of the first fixing member 130 may fix the first wire 201 and the second wire 202, respectively, in a state of being spaced from each other in the second direction D2. For example, the fourth fixing member 160 may fix the ninth wire 209 and the tenth wire 210 on the opposite sides of the connection part 111. Accordingly, the duct 100 may prevent the basket 52 from moving along the second direction D2 in the state of being coupled to the basket 52. In addition, the duct 100 may be maintained aligned with the basket 52 in the second direction D2 in the state of being coupled to the basket 52.

The duct 100 may hold the basket 52 substantially in the third direction D3. The duct 100 may hold the basket 52 substantially in the up-down direction (Z direction). For example, the first fixing part 1321 of the first fixing member 130 may fix the first wire 201 in the up-down direction. For example, the first fixing protrusion 1321*a* may fix the upper portion of the first wire 201, and the second fixing protrusion 1321*b* may fix the lower portion of the first wire 201. For example, the second fixing part 1322 of the first fixing member 130 may fix the second wire 202 in the up-down direction. For example, the third fixing protrusion 1322*a* may fix the upper portion of the second wire 202, and the fourth fixing protrusion 1322*b* may fix the lower portion of the second wire 202. Accordingly, the duct 100 may prevent the basket 52 from moving along the third direction D3 in the state of being coupled to the basket 52. In addition, the duct 100 may be maintained aligned with the basket 52 in the third direction D3 in the state of being coupled to the basket 52.

The duct 100 may prevent the basket 52 from rotating about the X axis (rotation in the XR direction). For example, the first fixing part 1321 and the second fixing part 1322 of the first fixing member 130 may fix the first wire 201 and the second wire 202, respectively. Accordingly, the duct 100 may, in the state of being coupled to the basket 52, prevent the basket 52 from being shaken or tilted as the basket 52 rotates about the X axis.

The duct 100 may prevent the basket 52 from rotating about the Y axis (rotation in the YR direction). For example, the first fixing part 1321 and the second fixing part 1322 of the first fixing member 130 may fix the first wire 201 and the second wire 202, respectively. For example, the third fixing member 150 may be spaced apart from the first fixing part 1321 and the second fixing part 1322 to fix the eighth wire 208. Accordingly, the duct 100 may, in the state of being coupled to the basket 52, prevent the basket 52 from being shaken or tilted as the basket 52 rotates about the Y axis.

The duct 100 may prevent the basket 52 from rotating about the Z axis (rotation in the ZR direction). For example, the first fixing part 1321 and the second fixing part 1322 of the first fixing member 130 may fix the first wire 201 and the second wire 202, respectively. For example, the fourth fixing member 160 may be spaced apart from the first fixing part 1321 and the second fixing part 1322 to fix the ninth wire 209 and the tenth wire 210. Accordingly, the duct 100 may, in the state of being coupled to the basket 52, prevent the basket 52 from being shaken or tilted as the basket 52 rotates about the Z axis.

According to the related art, when a duct does not fix a basket stably, the basket may move or shake, and this may cause the duct to not align properly with the basket. Accordingly, the duct and/or a spray unit connected to the duct may interfere with dishes. In addition, as the basket is tilted asymmetrically, it may be difficult to secure a space within a washing chamber.

In contrast, according to the present disclosure, the duct 100 may stably fix the basket 52. The duct 100 may prevent movement and/or shaking of the basket 52, and the duct 100 may be maintained properly aligned with the basket 52. The duct 100 may be disposed as close to the basket 52 as possible. For example, the duct 100 and the basket 52 may not interfere with the dishes accommodated in the basket 51. For example, a space 15 (see FIG. 2) between the basket 52 and the basket 51 may be secured as much as possible. As a result, space utilization inside the dishwasher 1 may be increased.

Figure 14:
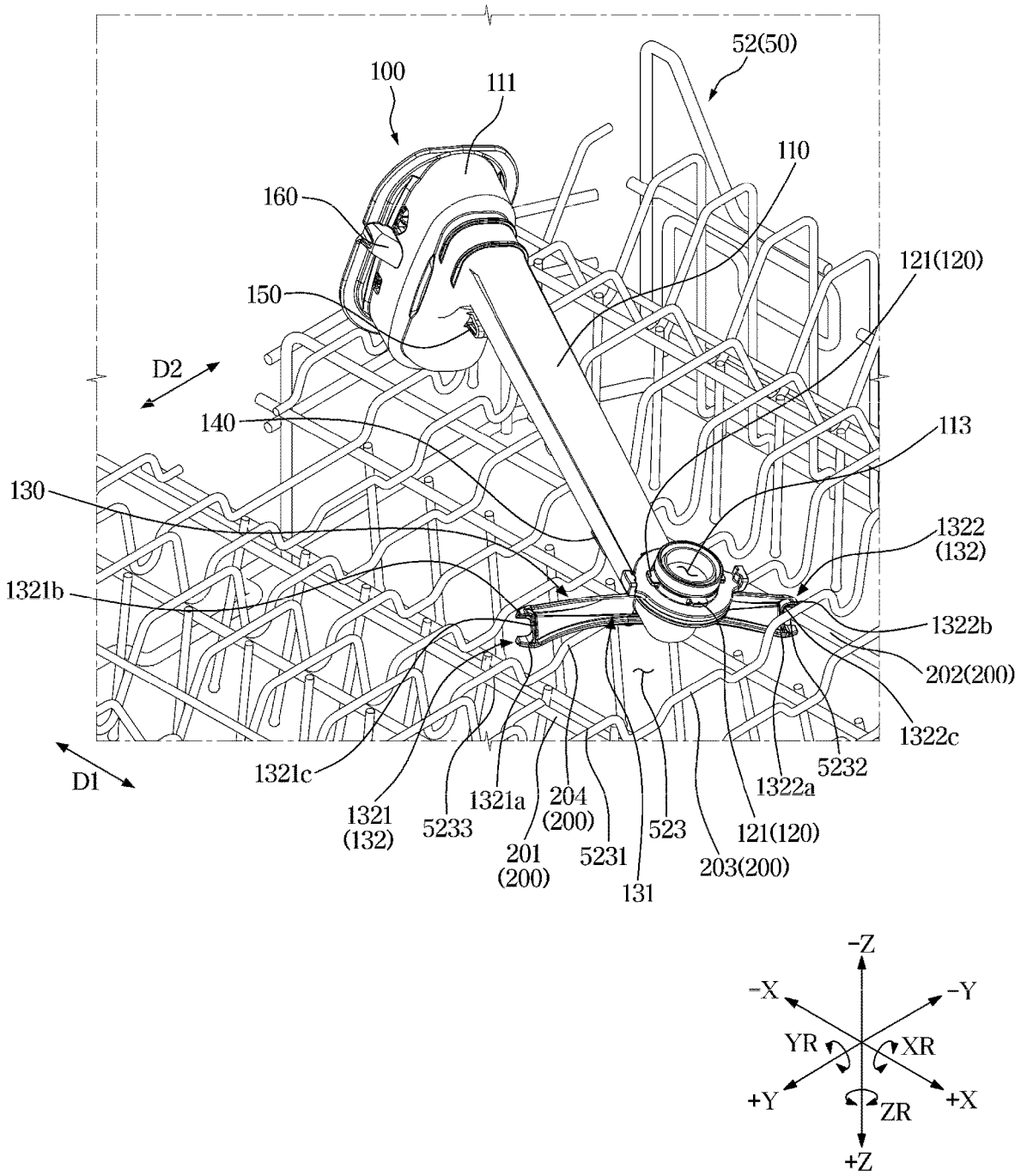
FIG. 14 illustrates a state in which a duct is placed in an opening of a basket.
Figure 15:
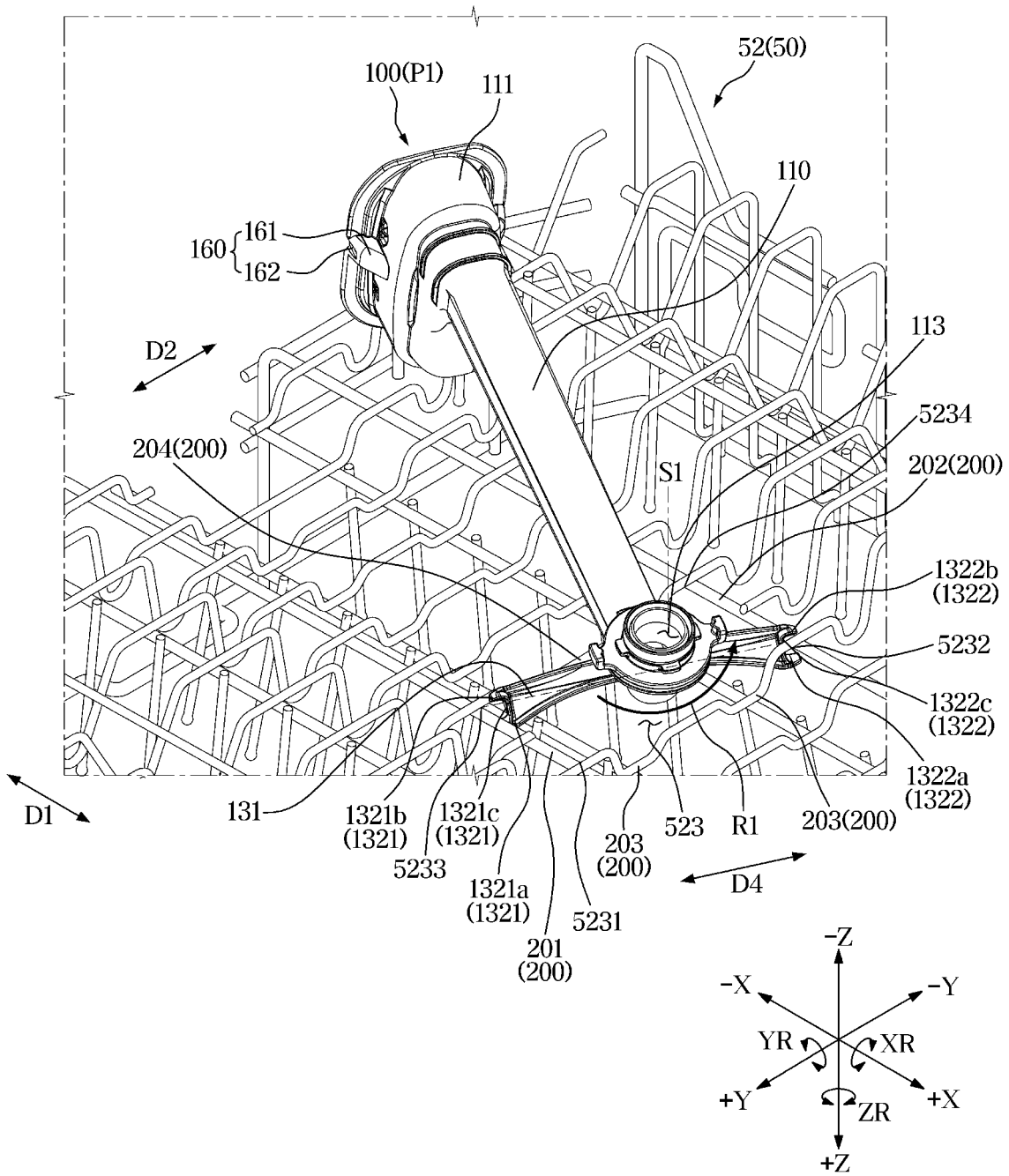
FIG. 15 illustrates a state in which the duct illustrated in FIG. 14 is placed in the opening of the basket in a diagonal direction.
Figure 16:
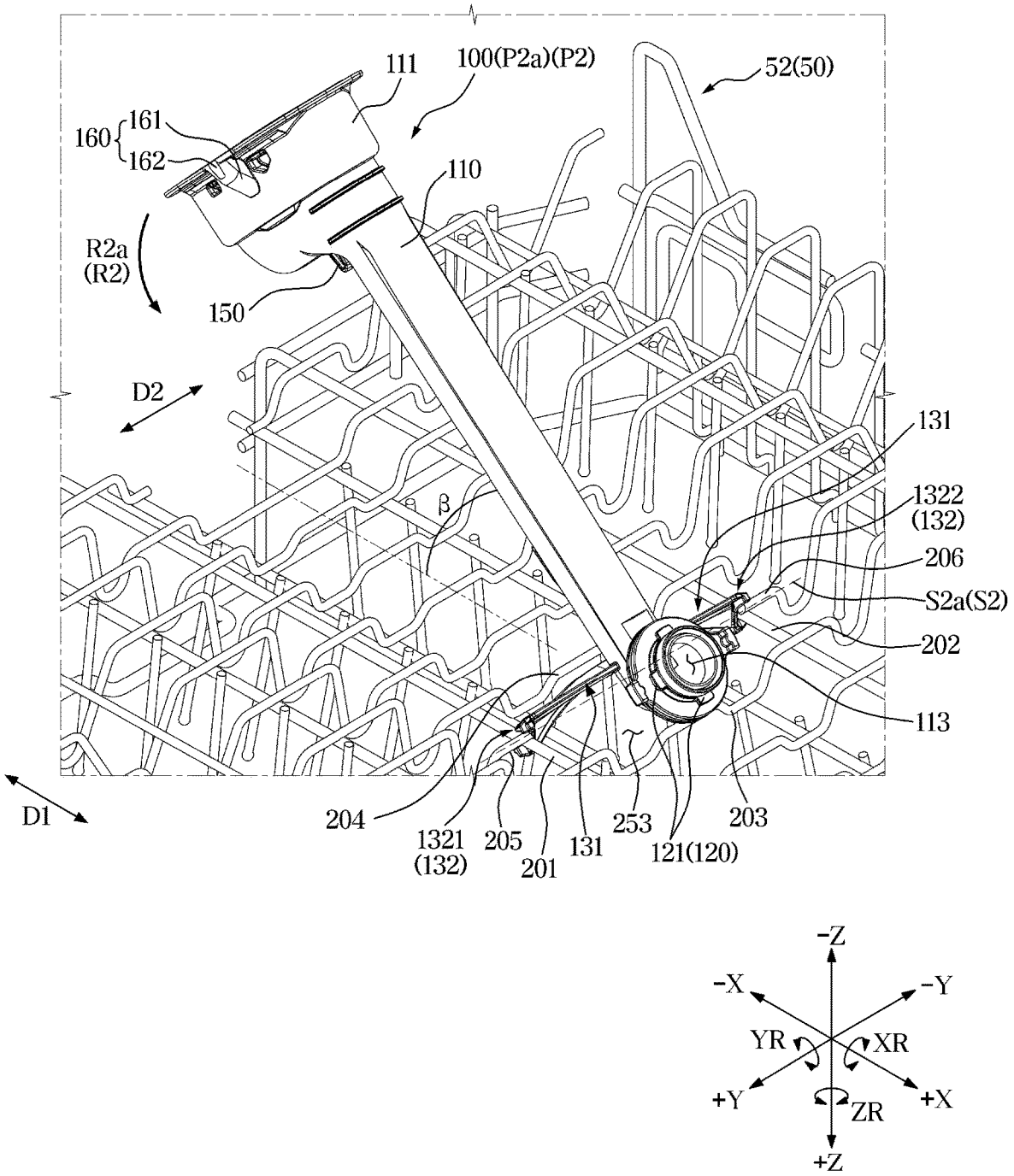
FIG. 16 illustrates a state in which the duct illustrated in FIG. 15 is rotated.
Figure 17:
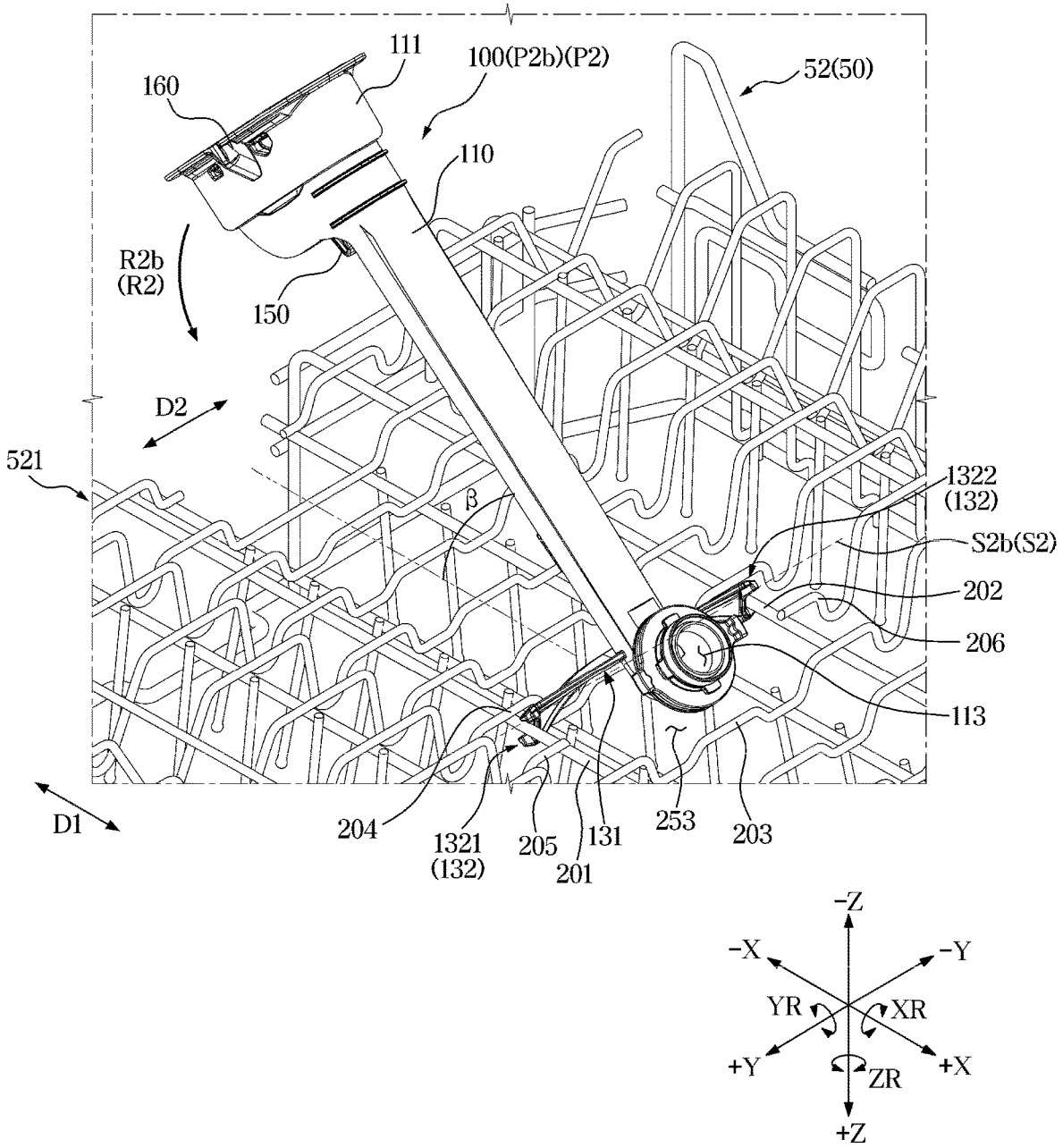
FIG. 17 illustrates a state in which the duct illustrated in FIG. 16 is moved in a front-rear direction.
Figure 18:
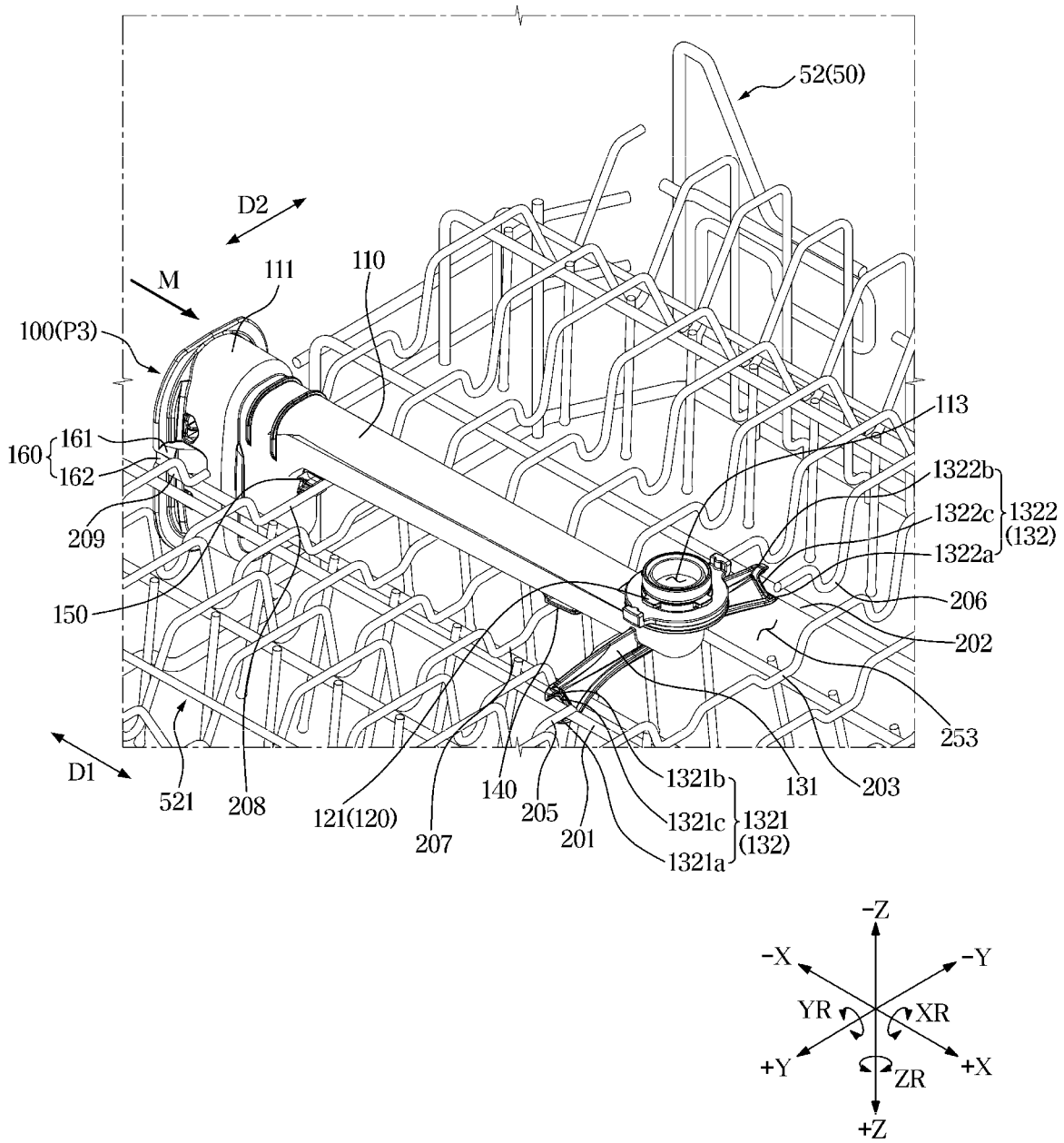
FIG. 18 illustrates a state in which the duct illustrated in FIG. 17 is rotated.
Figure 19:
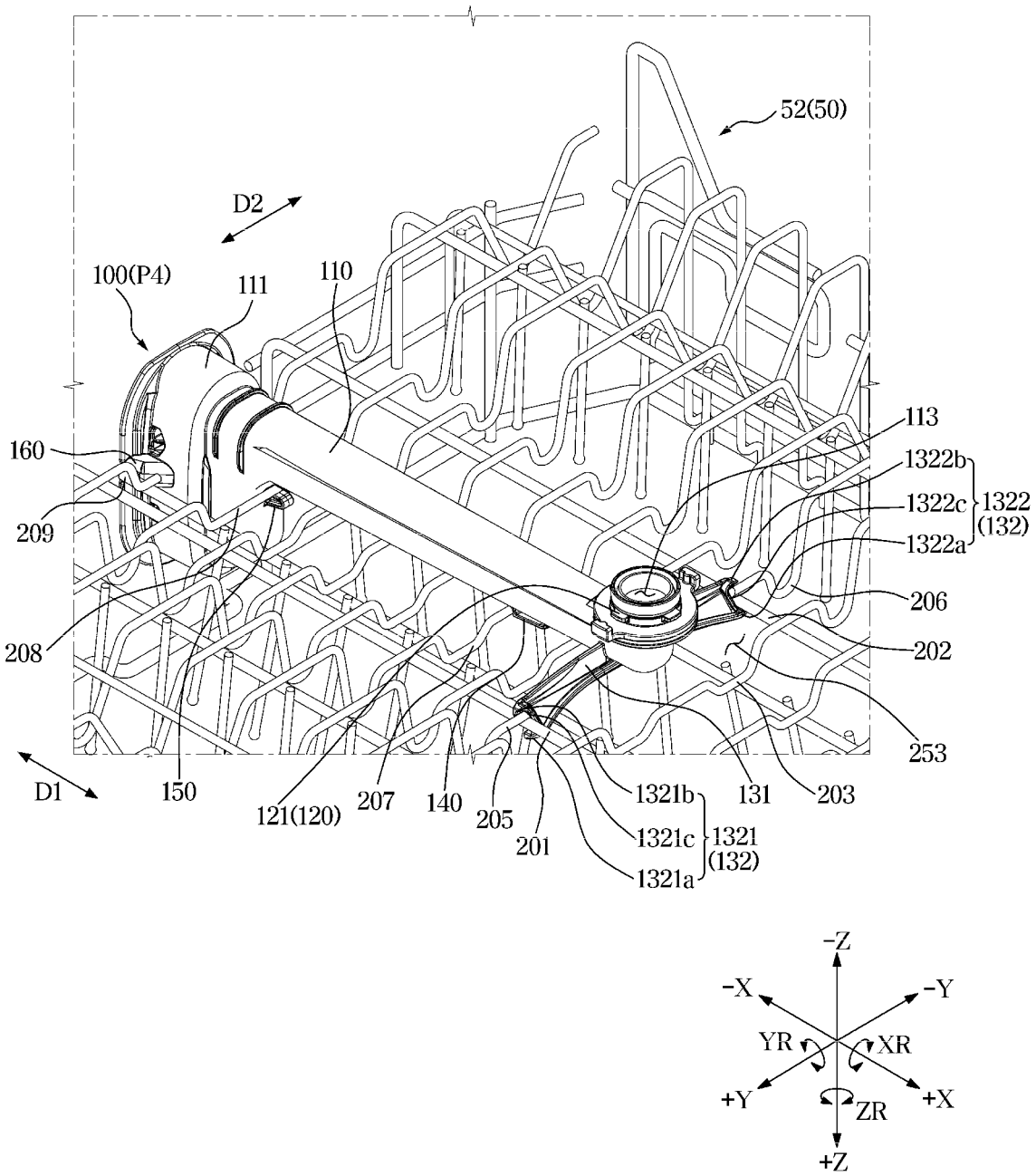
FIG. 19 illustrates a state in which the duct illustrated in FIG. 18 is moved in the front-rear direction.

FIG. 14 illustrates a state in which a duct is placed in an opening of a basket. FIG. 15 illustrates a state in which the duct illustrated in FIG. 14 is placed in the opening of the basket in a diagonal direction. FIG. 16 illustrates a state in which the duct illustrated in FIG. 15 is rotated. FIG. 17 illustrates a state in which the duct illustrated in FIG. 16 is moved in a front-rear direction. FIG. 18 illustrates a state in which the duct illustrated in FIG. 17 is rotated. FIG. 19 illustrates a state in which the duct illustrated in FIG. 18 is moved in the front-rear direction. The same member numbers are assigned to the same components, and detailed descriptions thereof may be omitted.

An example of a process in which the duct 100 is mounted on the basket 52 will be described below with reference to FIGS. 14 to 19. However, this is only an example, and the states of the duct 100 and the basket 52 are not limited to those illustrated in FIGS. 14 to 19. In addition, the ducts 100 may not be mounted on the basket 52 in the same order as illustrated in FIGS. 14 to 19. For example, when the duct 100 is mounted on the basket 52, some of the steps illustrated in FIGS. 14 to 19 may be omitted. For example, when the duct 100 is mounted on the basket 52, some of the steps illustrated in FIGS. 14 to 19 may be performed simultaneously. For example, when the duct 100 is mounted on the basket 52, steps other than those illustrated in FIGS. 14 to 19 may be added.

Referring to FIG. 14, in a state in which the basket 52 is turned upside down, the duct 100 may be mounted on the basket 52. For example, in a state in which the bottom part 521 of the basket 52 is disposed to face upward, the duct 100 may be assembled to the basket 52.

For example, the first fixing member 130 of the duct 100 may be placed in the opening 523 of the basket 52. For example, the second fixing part 132 of the first fixing member 130 may be first placed in the opening 523, and then the first fixing part 132 of the first fixing member 130 may be placed in the opening 523. However, unlike what is illustrated in FIG. 14, the first fixing part 132 of the first fixing member 130 may be first placed in the opening 523, and then the second fixing part 132 of the first fixing member 130 may be placed in the opening 523.

Referring to FIG. 15, the duct 100 may be located at a first position P1.

For example, the first fixing member 130 may be provided to be placed in the opening 523 along the diagonal direction D4 of the opening 523 (see FIG. 7) when the duct 100 is in the first position P1. For example, when the duct 100 is in the first position P1, the extension body 131 may be disposed to extend along the diagonal direction D4 (see FIG. 7) of the opening 523.

For example, the first fixing part 1321 of the first fixing member 130 may be disposed to correspond to the third corner 5233 of the opening 523, and the second fixing part 1322 of the first fixing member 130 may be disposed to correspond to the second corner 5232. However, unlike what is illustrated in FIG. 15, for example, the first fixing part 1321 of the first fixing member 130 may be disposed to correspond to the first corner 5231 of the opening 523, and the second fixing part 1322 of the first fixing member 130 may be disposed to correspond to the fourth corner 5234.

The duct 100 may enable a first rotation R1. The duct 100 may be provided to perform the first rotation R1 at the first position P1. For example, the first rotation R1 of the duct 100 may include rotating the duct 100 about a vertical axis. For example, the duct 100 may be provided to perform the first rotation R1 about an arbitrary axis S1 extending along the substantially vertical direction (Z direction).

Referring to FIGS. 16 and 17, the duct 100 may be located at a second position P2.

The duct 100 may move to the second position P2 as the duct performs the first rotation R1 in a state of being in the first position P1. That is, during the first rotation R1 of the duct 100, the duct 100 may move from the first position P1 to the second position P2.

For example, when the duct 100 is in the second position P2, the first fixing member 130 may be disposed to extend along the second direction D2 on the opening 523. For example, the first fixing member 130 may be provided to be placed in the opening 523 substantially along the left-right direction (Y direction) of the opening 523 when the duct 100 is in the second position P2. For example, when the duct 100 is in the second position P2, the extension body 131 may be disposed in the opening 523 to extend along the second direction D2.

For example, when the duct 100 is in the second position P2, the duct 100 may be disposed to form a predetermined angle β with the basket 52. For example, the duct body 110 may be disposed to be inclined at the predetermined angle β with respect to the wire extending in the first direction D1.

For example, as the duct 100 performs the first rotation R1 in the state of being in the first position P1, the first fixing member 130 may be disposed to extend along the second direction D2 on the opening 523, and the duct body 110 may be disposed to form the predetermined angle β with respect to the basket 52. However, the present disclosure is not limited thereto, and the steps of disposing the first fixing member 130 to extend along the second direction D2 on the opening 523 and disposing the duct body 110 to form the predetermined angle β with respect to the basket 52, may not proceed simultaneously.

The duct 100 may enable a second rotation R2. The duct 100 may be provided to perform the second rotation R2 at the second position P2. For example, the second rotation R2 of the duct 100 may include rotating the duct 100 about a left-right axis. For example, the duct 100 may be provided to perform the second rotation R2 about an arbitrary axis S2 extending substantially along the left-right direction (Y direction).

For example, referring to FIG. 16, the duct 100 may be located at a second-a position P2*a*. For example, when the duct 100 is in the second-a position P2*a*, the first fixing member 130 may be located at a midpoint of the opening 253 along the first direction D1. For example, the duct 100 may be provided to perform a second-a rotation R2*a* at the second-a position P2*a*. For example, the duct 100 may be provided to perform the second-a rotation R2*a* about an arbitrary axis S2*a* extending substantially along the left-right direction (Y direction) at the second-a position P2*a*. The second-a position P2*a* corresponds to an example of the second position P2 and may be referred to as the second position P2. The second-a rotation R2*a* corresponds to an example of the second rotation R2 and may be referred to as the second rotation R2.

For example, referring to FIG. 17, the duct 100 may be located at a second-b position P2*b*. For example, when the duct 100 is in the second-b position P2*b*, the first fixing member 130 may be located at the rear further than the midpoint of the opening 253 along the first direction D1. For example, the duct 100 may be provided to perform a second-b rotation R2*b* at the second-b position P2*b*. For example, the duct 100 may be provided to perform the second-b rotation R2*b* about an arbitrary axis S2*b* extending substantially along the left-right direction (Y direction) at the second-b position P2*b*. The second-b position P2*b* corresponds to an example of the second position P2 and may be referred to as the second position P2. The second-b rotation R2*b* corresponds to an example of the second rotation R2 and may be referred to as the second rotation R2.

As described above, the duct 100 may be provided to be located at the second position P2 as the duct rotates in the state of being located at the first position P1. For example, the duct 100 located at the first position P1 may be located at the second-a position P2*a* through the first rotation R1. For example, the duct 100 located at the first position P1 is located at the second-a position P2*a* through the first rotation R1, and then may be located at the second-b position P2*b* as the duct moves within a predetermined range (e.g., moving along the front-rear direction). For example, the duct 100 located at the first position P1 may be located at the second-b position P2*b* through the first rotation R1. The second position P2 of the duct 100 is not limited to the above-described example. The second-a position P2*a* and the second-b position P2*b* are only examples of the second position P2. In addition, the second rotation R2 of the duct 100 is not limited to the above-described example. The second-a rotation R2*a* and the second-b rotation R2*b* are also just examples of the second rotation R2.

Referring to FIG. 18, the duct 100 may be located at a third position P3.

The duct 100 may move to the third position P3 as the duct performs the second rotation R2 in a state of being in the second position P2. That is, during the second rotation R2 of the duct 100, the duct 100 may move from the second position P2 to the third position P3.

For example, the duct body 110 may be disposed to extend along the first direction D1 when the duct 100 is in the third position P3. For example, the duct body 110 may be disposed to extend substantially along the front-rear direction (X direction) when the duct 100 is located at the third position P3.

For example, the duct body 110 may be provided to be close to the basket 52 as the duct 100 performs the second rotation R2 in the state of being in the second position P2. For example, a distance between the duct body 110 and the basket 52 may gradually decrease as the duct 100 performs the second rotation R2 in the state of being in the second position P2. For example, the angle β formed between the duct body 110 and the basket 52 may gradually decrease as the duct 100 performs the second rotation R2 in the state of being in the second position P2.

For example, the first fixing member 130 may be provided to fix the first wire 201 and the second wire 202 when the duct 100 is located at the third position P3.

For example, the first fixing member 130 may be provided to fix the first wire 201 and the second wire 202 as the duct 100 performs the second rotation R2 in the state of being in the second position P2. For example, as the duct 100 rotates, the first fixing member 130 may also rotate, and accordingly, the first fixing part 3121 may be provided to be engaged with the first wire 201, and the second fixing part 3122 may be provided to be engaged with the second wire 202. A detailed explanation of this will be provided later.

The duct 100 may enable a movement M in the first direction D1. The duct 100 may be provided to perform the movement M in the first direction D1 at the third position P3. The duct 100 may perform the movement M substantially in the front-rear direction (X direction) at the third position P3.

Referring to FIG. 19, the duct 100 may be located at a fourth position P4. When the duct 100 is located at the fourth position P4, the duct 100 may be in a state of being mounted on the basket 52. When the duct 100 is located at the fourth position P4, the duct 100 may be in the state of being coupled to the basket 52.

The duct 100 may move to the fourth position P4 as the duct performs the movement M in the first direction D1 in a state of being in the third position P3. The duct 100 may move to the fourth position P4 as the duct performs the movement M substantially in the front-rear direction (X direction) in the state of being in the third position P3. That is, during the movement M of the duct 100 substantially in the front-rear direction (X direction), the duct 100 may move from the third position P3 to the fourth position P4.

For example, the first fixing member 130 may be provided to fix the first wire 201 and the second wire 202 when the duct 100 is located at the fourth position P4. However, the present disclosure is not limited thereto, and for example, the first fixing member 130 may be provided to fix the first wire 201 and the second wire 202 even when the duct 100 is located at the third position P3.

For example, the second fixing member 140 may be provided to fix the seventh wire 207 when the duct 100 is located at the fourth position P4. For example, the second fixing member 140 may be provided to fix the seventh wire 207 as the duct 100 performs the movement M in the first direction D1 in the state of being in the third position P3. For example, the seventh wire 207 may be provided to interfere with the hook protrusion 142 of the second fixing member 140 as the duct 100 performs the movement M in the first direction D1 in the state of being in the third position P3. Accordingly, a coupling force between the duct 100 and the basket 52 may be further increased.

For example, the third fixing member 150 may be provided to fix the eighth wire 208 when the duct 100 is located at the fourth position P4. For example, the third fixing member 150 may be provided to fix the eighth wire 208 as the duct 100 performs the movement M in the first direction D1 in the state of being in the third position P3. For example, the eighth wire 208 may be provided to be inserted into the third fixing groove 153 of the third fixing member 150 as the duct 100 performs the movement M in the first direction D1 in the state of being in the third position P3. Accordingly, the coupling force between the duct 100 and the basket 52 may be further increased.

For example, the fourth fixing member 160 may be provided to fix the ninth wire 209 and the tenth wire 210 when the duct 100 is located at the fourth position P4. For example, the fourth fixing member 160 may be provided to fix the ninth wire 209 and the tenth wire 210 as the duct 100 performs the movement M in the first direction D1 in the state of being in the third position P3. For example, the ninth wire 209 may be inserted into the support groove 162 of the right fixing member 160*a* as the duct 100 performs the movement M in the first direction D1 in the state of being in the third position P3. For example, the tenth wire 210 may be inserted into the support groove 162 of the left fixing member 160*b* as the duct 100 performs the movement M in the first direction D1 in the state of being in the third position P3. Accordingly, the coupling force between the duct 100 and the basket 52 may be further increased.

Meanwhile, the ordinals of "first," "second," "third," and "fourth" do not limit the first position P1, the second position P2, the third position P3, and the fourth position P4.

Figure 20:
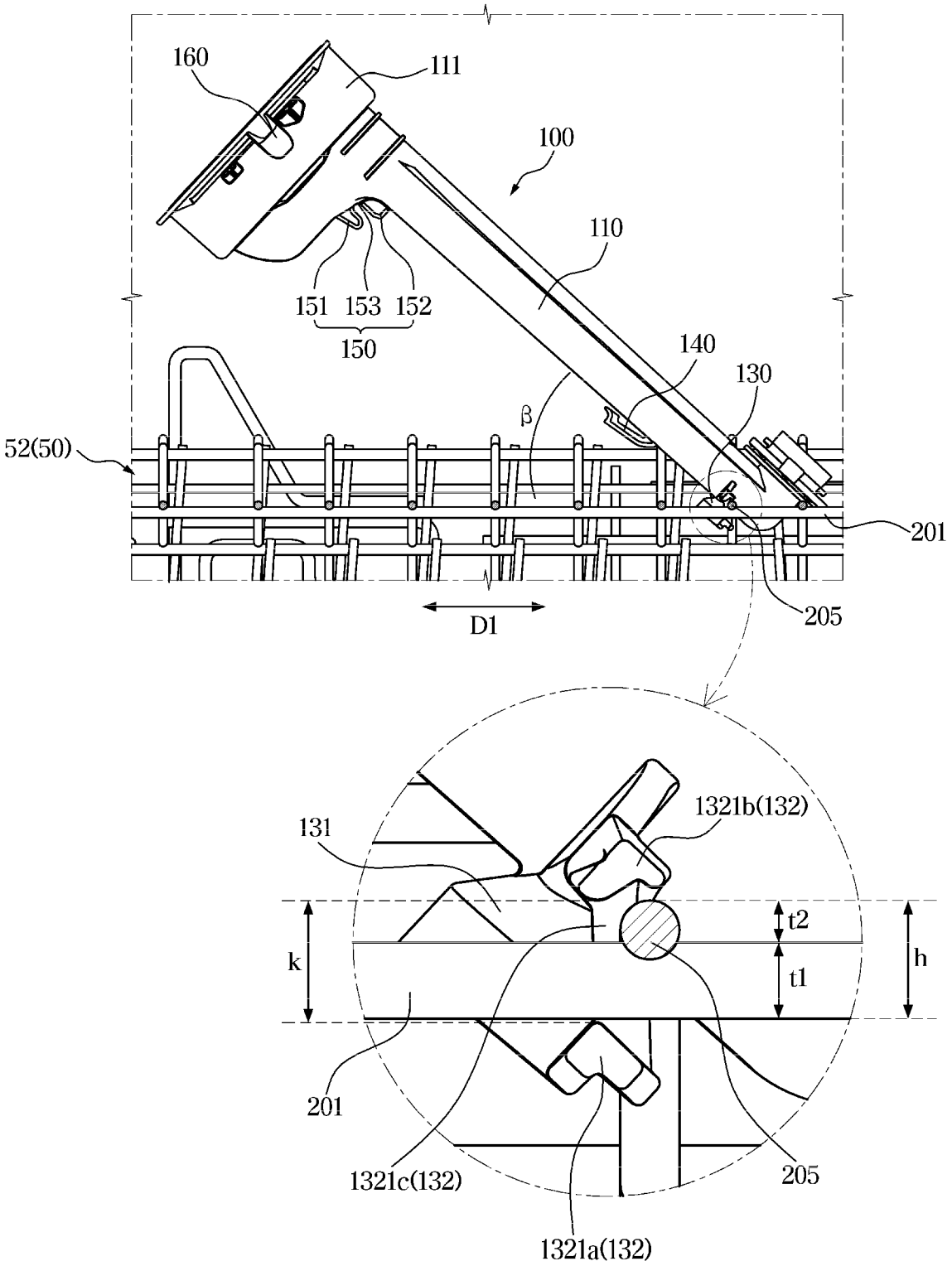
FIG. 20 illustrates an example of the duct being assembled into the basket.
Figure 21:
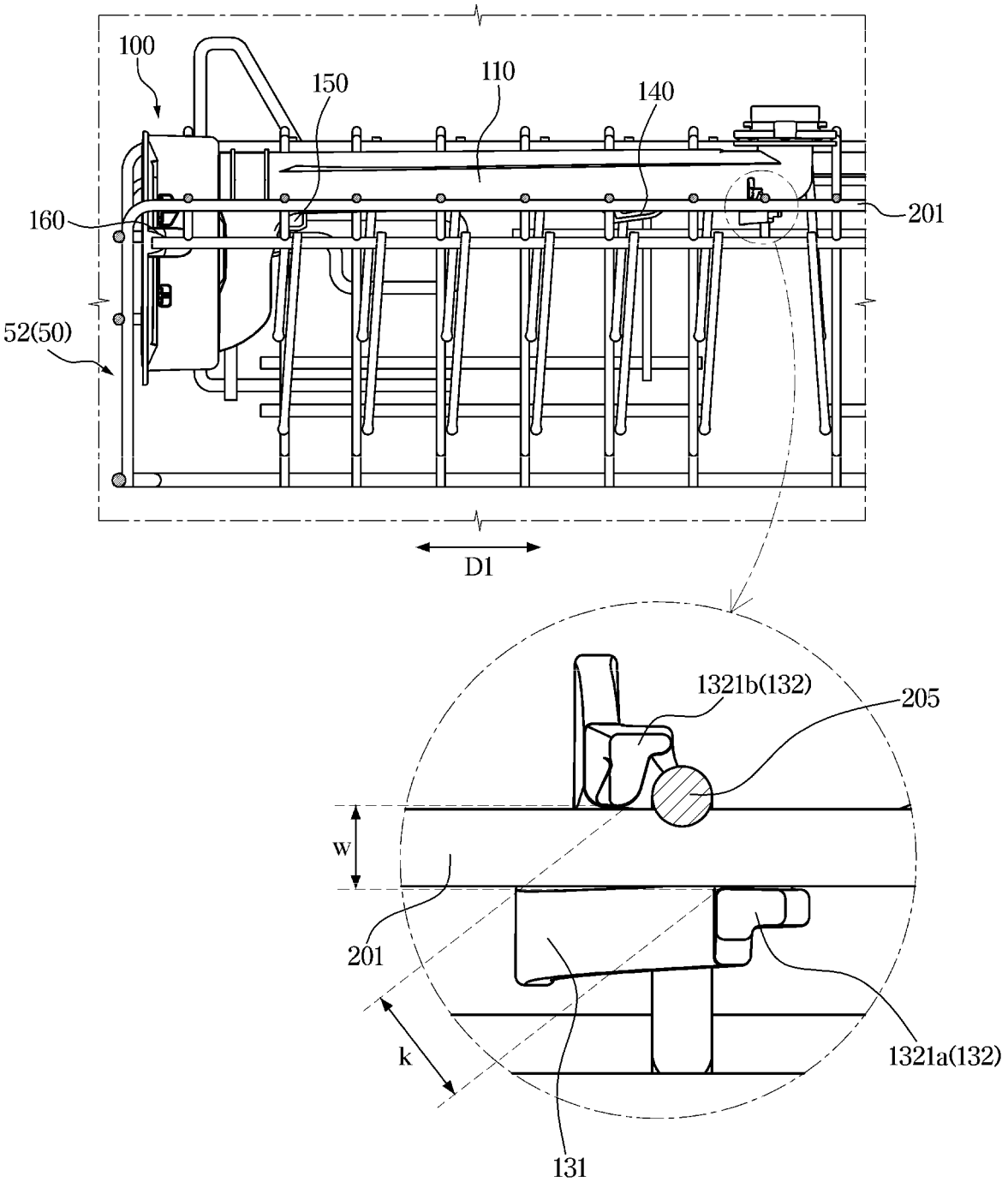
FIG. 21 illustrates an example of a state in which the duct is assembled into the basket.

FIG. 20 illustrates an example of the duct being assembled into the basket. FIG. 21 illustrates an example of a state in which the duct is assembled into the basket. The same member numbers are assigned to the same components, and detailed descriptions thereof may be omitted.

Referring to FIG. 20, in the process of assembling the duct 100 to the basket 52, the duct 100 may be provided to form the predetermined angle β with respect to the basket 52. The duct body 110 of the duct 100 may be disposed to be inclined at the predetermined angle β with respect to the wire extending in the first direction D1. For example, the duct 100 may be located at the second position P2.

For example, a distance k between the first fixing protrusion 1321*a* and the second fixing protrusion 1321*b* of the first fixing part 1321 in a state in which the duct 100 is provided to form the predetermined angle β with respect to the basket 52 may be longer than a height h of the at least one wire 201 or 205 corresponding to the first fixing part 1321. For example, the height h may include a height t1 of the first wire 201 and a height t2 at which the fifth wire 205 protrudes from the first wire 201. Accordingly, the duct 100 may not interfere with the wires 201 and 202 in the state in which the duct 100 is provided to form the predetermined angle β with respect to the basket 52. In the state in which the duct 100 is provided to form the predetermined angle β with respect to the basket 52, the duct 100 may easily move along the first direction D1. For example, the duct 100 may move within the predetermined range substantially along the front-rear direction (X direction) in the state of forming the predetermined angle β with respect to the basket 52. The above-described relationship may also be applied to the relationship between the second fixing part 1322 and the at least one wire 202 or 206 corresponding to the second fixing part 1322.

Referring to FIG. 21, the duct body 110 of the duct 100 may be provided to extend along the first direction D2 in a state in which the duct 100 is assembled to the basket 52. For example, the duct 100 may be located at the third position P3. For example, the duct 100 may be located at the fourth position P4.

For example, the distance k between the first fixing protrusion 1321*a* and the second fixing protrusion 1321*b* of the first fixing part 1321 in the state in which the duct 100 is provided to form the predetermined angle β with respect to the basket 52 may be longer than a distance w between the first fixing protrusion 1321*a* and the second fixing protrusion 1321*b* of the first fixing part 1321 in the state in which the duct 100 is assembled to the basket 52. As the duct 100 is assembled to the basket 52, a distance between the first fixing protrusion 1321*a* and the second fixing protrusion 1321*b* may be reduced. For example, as the duct 100 rotates within a predetermined range (e.g., second rotation R2) in the state of being provided to form the predetermined angle β with respect to the basket 52, the first fixing protrusion 1321*a* may fix the upper portion of the first wire 201, and the second fixing protrusion 1321*b* may fix the lower portion of the first wire 201. The above-described relationship may also be applied to the relationship between the third fixing protrusion 1322*a* and the fourth fixing protrusion 1322*b* of the second fixing part 1322.

Figure 22:
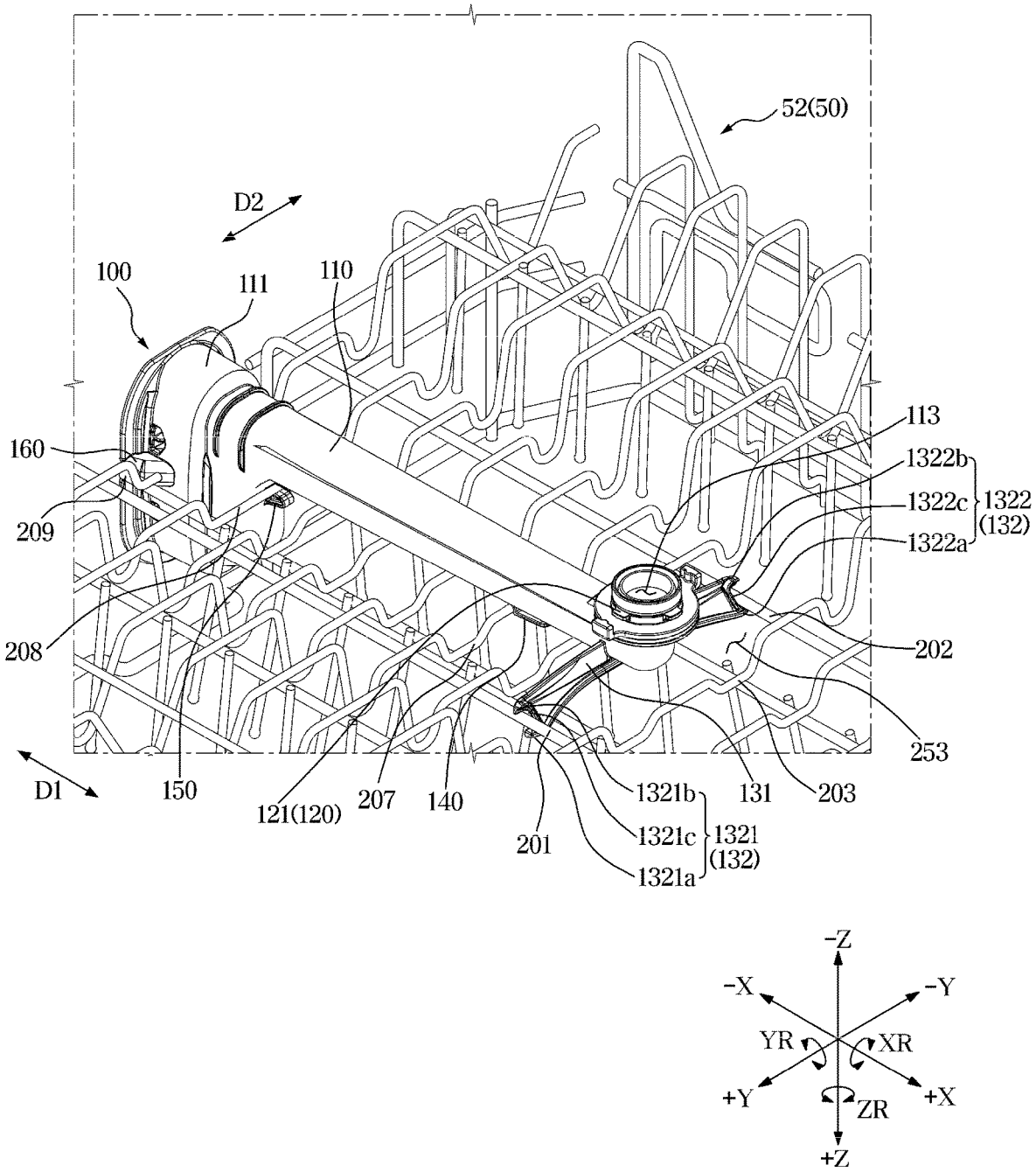
FIG. 22 is a schematic perspective view of an example of some components of the dishwasher according to an embodiment.
Figure 23:
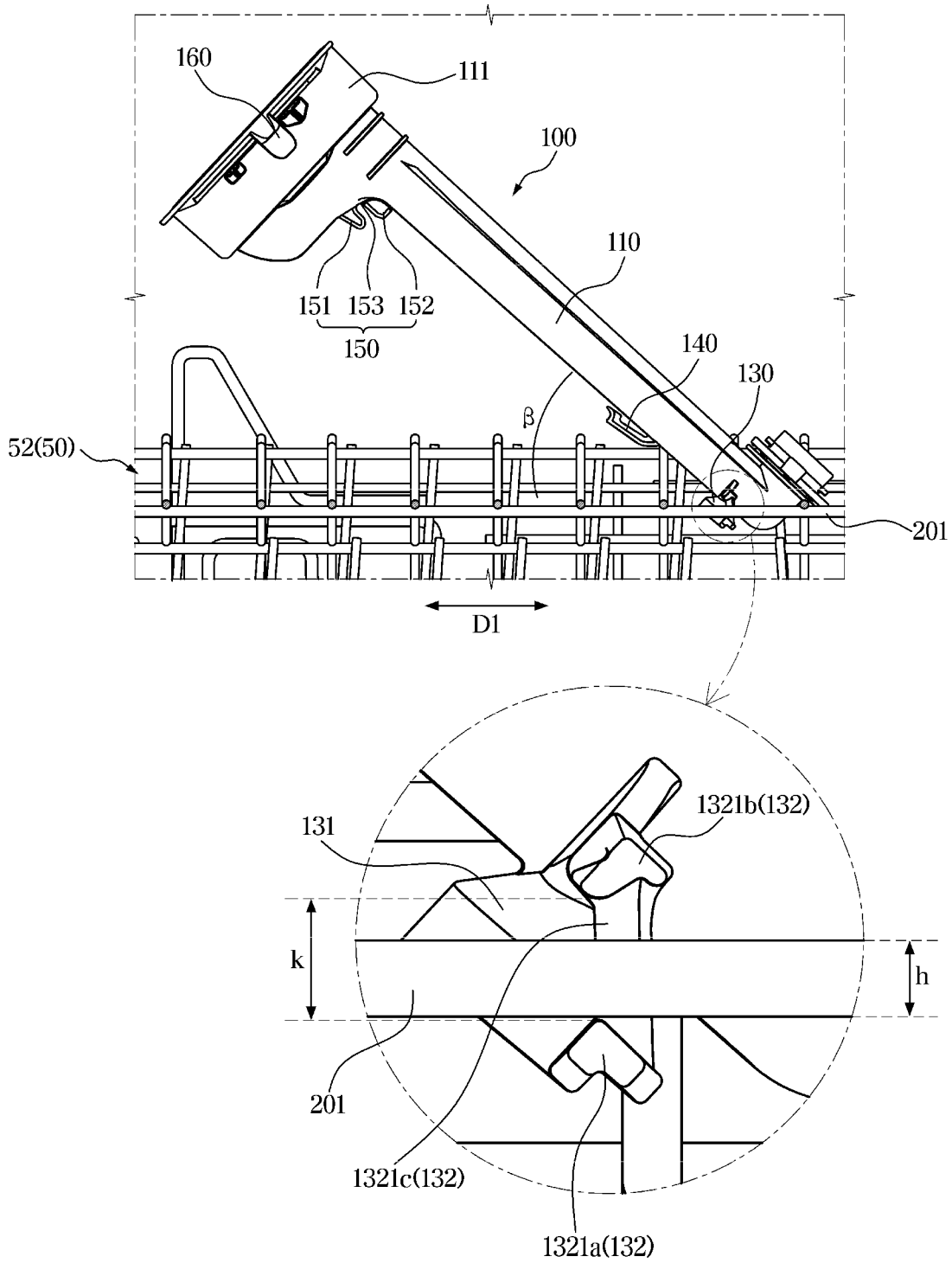
FIG. 23 illustrates an example of the duct being assembled into the basket.
Figure 24:
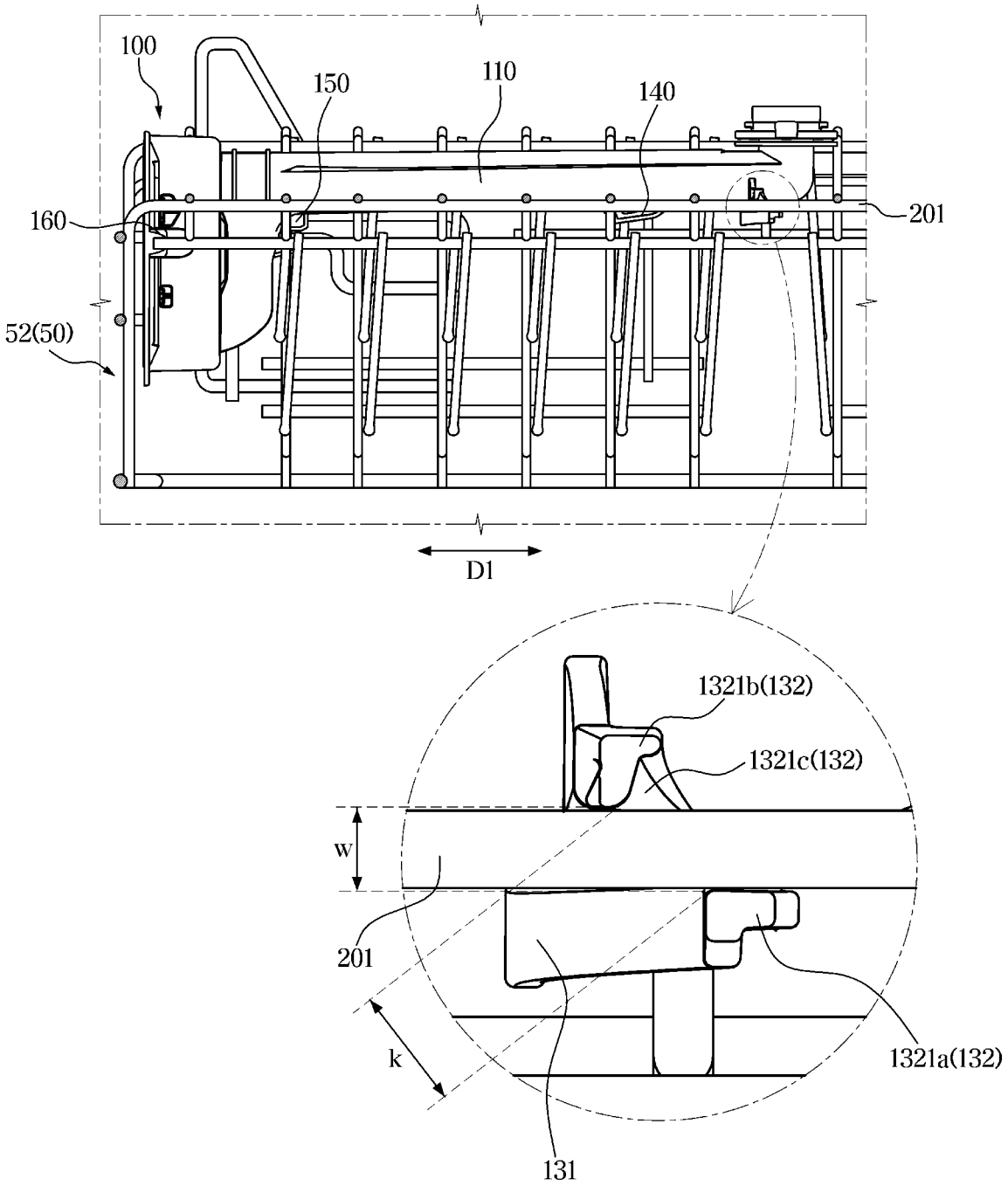
FIG. 24 illustrates an example of a state in which the duct is assembled into the basket.

FIG. 22 is a schematic perspective view of an example of some components of the dishwasher according to an embodiment. FIG. 23 illustrates an example of the duct being assembled into the basket. FIG. 24 illustrates an example of a state in which the duct is assembled into the basket. Compared to the basket illustrated in FIG. 19, the basket illustrated in FIG. 22 may not include the fifth wire 205 and the sixth wire 206. Compared to the basket illustrated in FIGS. 20 and 21, the basket illustrated in FIGS. 23 and 24 may not include the fifth wire 205 and the sixth wire 206. The same member numbers are assigned to the same components, and detailed descriptions thereof may be omitted.

For example, referring to FIG. 23, the distance k between the first fixing protrusion 1321*a* and the second fixing protrusion 1321*b* of the first fixing part 1321 in the state in which the duct 100 is provided to form the predetermined angle β with respect to the basket 52 may be longer than the height of the first wire 201 corresponding to the first fixing part 1321. Similar to what is described with reference to FIGS. 20 and 21, in the state in which the duct 100 is provided to form the predetermined angle β with respect to the basket 52, the duct 100 may not interfere with the first wire 201. The above-described relationship may also be applied to the relationship between the second fixing part 1322 and the second wire 202.

For example, referring to FIG. 24, the distance k between the first fixing protrusion 1321*a* and the second fixing protrusion 1321*b* of the first fixing part 1321 in the state in which the duct 100 is provided to form the predetermined angle β with respect to the basket 52 may be longer than the distance w between the first fixing protrusion 1321*a* and the second fixing protrusion 1321*b* of the first fixing part 1321 in the state in which the duct 100 is assembled to the basket 52. Similar to what is described with reference to FIGS. 20 and 21, as the duct 100 is assembled to the basket 52, the distance between the first fixing protrusion 1321*a* and the second fixing protrusion 1321*b* may decrease. The above-described relationship may also be applied to the relationship between the third fixing protrusion 1322*a* and the fourth fixing protrusion 1322*b* of the second fixing part 1322.

In the related art, a duct may generally be simply assembled to a wire in an up-and-down direction (or left-right direction). In this case, a certain tolerance may be required for the assembly of the duct and a basket, and the rigidity of the duct may be relatively low. Because of this, it may be difficult for the duct to stably fix the basket, and the basket may easily move or shake. In addition, a coupling force between the basket and the duct may be reduced. As the basket and the duct become misaligned, dishes may collide with the basket and/or the duct.

In contrast, according to the present disclosure, the duct 100 may be coupled to the basket 52 by rotating with respect to the basket 52 in the state in which the first fixing member 130 is placed in the opening 523. The duct 100 may be firmly mounted on the basket 52 by being rotationally assembled to the basket 52. The duct 100 may stably fix the wire of the basket 52. The dishes may not collide with the basket 52 and/or the duct 100.

For example, as the duct 100 performs the first rotation R1, the first fixing member 130 may be changed from a state of being placed along the diagonal direction D4 of the opening 523 to a state of being placed along the second direction D2 of the opening 523. As the duct 100 performs the first rotation R1, the first fixing member 130 may be provided to be inserted between the first wire 201 and the second wire 202 in the opening 253. Accordingly, the wire fixing force of the first fixing member 130 may be increased. In addition, a tolerance for assembling the duct 100 and the basket 52 may be relatively small.

For example, as the duct 100 performs the second rotation R2, the fixing part 132 of the first fixing member 130 may fix the first wire 201 and the second wire 202. For example, as the second rotation R2 is performed, the distance between the first fixing protrusion 1321*a* and the second fixing protrusion 1321*b* may be reduced. The first fixing protrusion 1321*a* and the second fixing protrusion 1321*b* may hold the first wire 201 in the up-down direction. For example, as the second rotation R2 is performed, a distance between the third fixing protrusion 1322*a* and the fourth fixing protrusion 1322*b* may be reduced. The third fixing protrusion 1322*a* and the fourth fixing protrusion 1322*b* may hold the second wire 202 in the up-down direction.

For example, as the movement M of the duct 100 is performed, the second fixing member 140 may fix the seventh wire 207, the third fixing member 150 may fix the eighth wire 208, and the fourth fixing member 160 may fix the ninth wire 209 and the tenth wire 210. Accordingly, the coupling force between the duct 100 and the basket 52 may be further increased.

The dishwasher 1 may include the tub 12 provided to accommodate dishes within the tub and including the wire 201, the basket 52, and the duct 100 detachably coupled to the basket to guide washing water to be sprayed into the dishes. The duct 100 may include the first fixing protrusion 1321*a* provided to fix the upper portion of the wire 201 and the second fixing protrusion 1321*b* provided to fix the lower portion of the wire 201. The second fixing protrusion 1321*b* may be spaced apart from the first fixing protrusion 1321*a* along the extension direction of the wire.

The duct 100 may include a duct body 110 forming a flow path for washing water to flow. The duct 100 may include the extension body 131 extending from the duct body. The duct 100 may include the fixing part 132 formed on one side of the extension body 131 and including the first fixing protrusion and the second fixing protrusion.

The extension direction of the wire may be the first direction D1. The fixing part 132 may be the first fixing part 1321. The duct 100 may include the second fixing part 1322 formed on the other side of the extension body. The second fixing part 1322 may include the third fixing protrusion 1322*a* spaced apart from the first fixing protrusion along the second direction D2 intersecting the first direction. The second fixing part 132 may include the fourth fixing protrusion 1322*b* spaced apart from the second fixing protrusion along the second direction D2.

The wire may be the first wire 201 extending along the first direction. The basket may further include the second wire 202 spaced apart from the first wire along the second direction intersecting the first direction and extending along the first direction. The duct 100 may include the third fixing protrusion 1322*a* provided to fix the upper portion of the second wire. The duct 100 may include the fourth fixing protrusion 1322*b* spaced apart from the third fixing protrusion along the first direction and provided to fix the lower portion of the second wire.

The extension direction of the wire may be the first direction D1. The first fixing protrusion 1321*a* and the second fixing protrusion 1321*b* may be provided to protrude further than the wire 201 along the second direction D2 intersecting the first direction.

The extension direction of the wire may be the first direction D1. The duct body 110 may be disposed to extend along the first direction in the state in which the duct is coupled to the basket. The extension body 131 may be disposed to extend along the second direction D2 intersecting the first direction in the state in which the duct is coupled to the basket.

The basket 52 may further include the opening 523 provided to allow washing water to pass therethrough. The duct 100 may be coupled to the basket by rotating with respect to the basket in the state in which the extension body 131 is placed in the opening 523.

The extension direction of the wire may be the first direction D1. The rotation of the duct may include the rotation R1 for moving the duct from the first position P1 to the second position P2. The extension body 131 may be disposed in the opening to extend along the diagonal direction of the opening when the duct is in the first position P1. The extension body 131 may be disposed in the opening to extend along the second direction intersecting the first direction when the duct is in the second position P2.

The rotation of the duct may include the rotation R2 for moving the duct from the first position P2 to the second position P3. The duct body 110 may be disposed to be inclined at the predetermined angle β with respect to the wire when the duct is in the first position P2. The duct body 110 may be disposed to extend along the first direction when the duct is in the second position P3.

The extension length L of the extension body may be shorter than the length e of the opening 253 in the diagonal direction.

When the duct is in the first position P2, the distance k between the first fixing protrusion and the second fixing protrusion may be longer than the height h of the wire.

The duct 100 may further include the fixing groove 1321*c* formed between the first fixing protrusion 1321*a* and the second fixing protrusion 1321*b* to accommodate the wire. The distance a between the fixing groove 1321*c* and the center of the wire 201 may be shorter than the diameter b of the wire.

The wire may be the first wire extending along the first direction. The basket may further include the second wire 207 extending along the second direction D2 intersecting the first direction. The duct 100 may further include the hook 140 formed on the duct body 110 to fix the second wire 207.

The hook 140 may include the hook body 141 extending from the upper portion of the duct body, and the hook protrusion 142 formed at an end of the hook body 141 to interfere with the second wire 207. In the state in which the duct coupled to the basket, the distance c between the lower end of the hook protrusion and the upper portion of the duct body may be shorter than the distance d between the upper end of the hook protrusion and a lower end of the second wire.

The dishwasher 1 may further include the spray rotor 42 provided to enable communication with the duct spray washing water guided by the duct into the dishes.

The dishwasher 1 may include the tub 12, the basket 52 disposed inside the tub, the spray rotor 42 provided to spray washing water toward the dishes, and the duct 100 provided to guide washing water to the spray rotor. The basket 52 may include the bottom part 521 supporting dishes, the opening 523 through which a portion of the bottom part is open, and the plurality of wires 200 forming the bottom part and the opening. The duct 100 may include the duct body 110 forming a flow path for washing water to flow, and the fixing member 130 extending to intersect the extension direction of the duct body to fix the basket. The duct may be provided to enable the first rotation R1 and the second rotation R2. During the first rotation R1 of the duct, the fixing member may be provided to be placed in the opening 253 along the left-right direction of the opening from the state of being placed in the opening 253 along the diagonal direction of the opening. During the second rotation R2 of the duct, the duct body may be provided to be close to the basket.

The plurality of wires 200 of the basket may include the first wire 201 extending along the front-rear direction and the second wire 207 extending along the left-right direction. The fixing member 130 of the duct may be provided to fix the first wire 201. The duct 100 may further include the hook 140 provided to be spaced apart from the fixing member 130 along the front-rear direction to fix the second wire 207.

The hook 140 may be provided to interfere with the second wire 207 as the duct performs the first rotation R1 and the second rotation R2 and then performs the movement M in the front-rear direction.

The first rotation R1 may include rotating about the vertical axis.

The second rotation R2 may include rotating about the left-right axis.

According to the present disclosure, space utilization of a dishwasher can be improved. For example, the dishwasher can accommodate large dishes. For example, the dishwasher can accommodate a larger number of dishes.

According to the present disclosure, the dishwasher can prevent a duct and/or a spray unit from interfering with dishes. According to the present disclosure, the dishwasher can prevent the duct and/or the spray unit from colliding with dishes.

According to the present disclosure, the ease of assembly of the duct and basket of the dishwasher can be improved. According to the present disclosure, a coupling force between the duct and basket of the dishwasher can be improved. For example, an assembly tolerance of the basket and duct can be relatively small. For example, the basket and the duct cannot be easily shaken.

Effects obtainable from the present disclosure are not limited to the effects mentioned above, and other effects not mentioned will be clearly understood by those skilled in the art from the description below.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

What is claimed is:

1. A dishwasher comprising:

a tub;

a basket to accommodate objects to wash therein, the basket comprising a plurality of wires extending along a first direction and forming the basket, the plurality of wires including a first wire; and a duct detachably coupled to the basket to guide washing water to be sprayed into the objects, wherein the duct comprises:

a duct body having a flow path therein for the washing water to flow, the duct body extending along the first direction based on the duct being coupled to the basket;

an extension body extending in a second direction intersecting the first direction;

a fixing part formed on one end of the extension body, the fixing part comprising:

a first fixing protrusion to fix an upper portion of the first wire; and a second fixing protrusion to be spaced apart from the first fixing protrusion to fix a lower portion of the first wire.

2. The dishwasher according to claim 1, wherein:

the fixing part is a first fixing part;

the plurality of wires further comprises a second wire spaced apart from the first wire along the second direction and extending along the first direction; and the duct further comprises:

a second fixing part formed on an other side end of the extension body, the second fixing part comprising:

a third fixing protrusion to fix an upper portion of the second wire; and a fourth fixing protrusion provided to be spaced apart from the third fixing protrusion to fix a lower portion of the second wire.

3. The dishwasher according to claim 2, wherein the duct further comprises a hook formed on the duct body to fix the second wire.

4. The dishwasher according to claim 3, wherein the hook comprises a hook body extending from an upper portion of the duct body and a hook protrusion formed on an end of the hook body to interfere with the second wire, and based on the duct being coupled to the basket, a distance between a lower end of the hook protrusion and the upper portion of the duct body is shorter than a distance between an upper end of the hook protrusion and a lower end of the second wire.

5. The dishwasher according to claim 1, wherein the first fixing protrusion and the second fixing protrusion protrude further than the first wire along the second direction intersecting the first direction.

6. The dishwasher according to claim 1, wherein the duct further comprises a fixing groove formed between the first fixing protrusion and the second fixing protrusion to accommodate the first wire, and a distance between the fixing groove and a center of the first wire is shorter than a diameter of the first wire.

7. The dishwasher according to claim 1, further comprising a spray rotor to enable communication with the duct to spray washing water guided by the duct into the objects.

8. A dishwasher comprising:

a tub;

a basket to accommodate objects to wash therein, the basket comprising:

a plurality of wires extending along a first direction and forming the basket, the plurality of wires including a first wire; and an opening to allow washing water to pass therethrough; and a duct detachably coupled to the basket to guide washing water to be sprayed into the objects, wherein the duct comprises:

a duct body having a flow path therein for the washing water to flow, the duct body extending along the first direction based on the duct being coupled to the basket;

an extension body extending in a second direction intersecting the first direction;

a fixing part formed on one end of the extension body, the fixing part comprising:

a first fixing protrusion to fix an upper portion of the first wire; and a second fixing protrusion to be spaced apart from the first fixing protrusion to fix a lower portion of the first wire, and wherein the duct is coupled to the basket by rotating with respect to the basket based on the extension body being placed in the opening.

9. The dishwasher according to claim 8, wherein the duct is configured to be rotated from a first position to a second position, the extension body is disposed in the opening to extend along a diagonal direction of the opening based on the duct being in the first position, and the extension body is disposed in the opening to extend along the second direction intersecting the first direction based on the duct being in the second position.

10. The dishwasher according to claim 9, wherein an extension length of the extension body is shorter than a length of the opening in the diagonal direction.

11. The dishwasher according to claim 8, wherein the duct is configured to be rotated a first position to a second position, the duct body is inclined at a predetermined angle with respect to the first wire based on the duct being in the first position, and the duct body is disposed to extend along the first direction based on the duct being in the second position.

12. The dishwasher according to claim 11, wherein based on the duct being in the first position, a distance between the first fixing protrusion and the second fixing protrusion is longer than a height of the first wire.

* * * * *